US008402908B2

(12) United States Patent
Gerst et al.

(10) Patent No.: US 8,402,908 B2
(45) Date of Patent: Mar. 26, 2013

(54) DOCK SYSTEM

(76) Inventors: Paul R. Gerst, Newport Beach, CA (US); Paul Vernon Gerst, Laguana Niguel, CA (US); John William Gerst, Chula Vista, CA (US)

( * ) Notice: Subject to any disclaimer, the term of this patent is extended or adjusted under 35 U.S.C. 154(b) by 0 days.

(21) Appl. No.: 13/346,904

(22) Filed: Jan. 10, 2012

(65) Prior Publication Data

US 2012/0103243 A1 May 3, 2012

Related U.S. Application Data

(63) Continuation of application No. 12/565,641, filed on Sep. 23, 2009, now Pat. No. 8,168,901, which is a continuation-in-part of application No. 12/146,326, filed on Jun. 25, 2008, now Pat. No. 7,640,881.

(51) Int. Cl.
*B63B 35/44* (2006.01)

(52) U.S. Cl. ..... 114/263; 114/266; 114/267; 405/219

(58) Field of Classification Search ..... 114/263, 114/264, 266, 267; 405/218, 219, 220, 221; 211/182; 296/29
See application file for complete search history.

(56) References Cited

U.S. PATENT DOCUMENTS

| | | | | |
|---|---|---|---|---|
| 3,279,141 | A | 10/1966 | Schmidt | |
| 3,760,754 | A | 9/1973 | Drummond et al. | |
| 4,070,980 | A | 1/1978 | Shorter, Jr. | |
| 4,260,293 | A | 4/1981 | Peterson | |
| 4,660,495 | A | 4/1987 | Thompson | |
| 4,709,647 | A | 12/1987 | Rytand | |
| 4,867,093 | A | 9/1989 | Sullivan | |
| 4,940,021 | A | 7/1990 | Rytand | |
| 5,355,825 | A * | 10/1994 | Lefebvre et al. | 114/267 |
| 5,429,063 | A | 7/1995 | Rosenkranz | |
| 5,584,606 | A | 12/1996 | Hoogasian, Jr. | |
| 5,845,594 | A | 12/1998 | Hallsten et al. | |
| 6,205,945 | B1 | 3/2001 | Passen et al. | |
| 6,230,644 | B1 | 5/2001 | Passen et al. | |
| 6,334,642 | B1 * | 1/2002 | Waldeck et al. | 296/29 |
| 6,431,794 | B1 | 8/2002 | Zweber | |
| 6,796,262 | B2 | 9/2004 | Moses | |
| 7,107,923 | B2 | 9/2006 | Chauncey et al. | |
| 7,213,531 | B2 | 5/2007 | Ahern | |
| 7,640,881 | B1 | 1/2010 | Gerst et al. | |
| 8,166,901 | B2 * | 5/2012 | Gerst et al. | 114/263 |
| 2009/0110487 | A1 | 4/2009 | Hawkins et al. | |

OTHER PUBLICATIONS

Flotation Systems, Inc.; Catalog for Aluminum Boat Docks; (15 pages).
Boat Dock Construction; Website Article; http://www.aluminumboatdocks.com; (2 pages).
Anchoring Systems; Website Article; http://www.aluminumboatdocks.com; (4 pages).
Marina and Dock Applications; Website Article; http://www.strongwell.com; (2 pages).

(Continued)

*Primary Examiner* — Lars A Olson
(74) *Attorney, Agent, or Firm* — Stetina Brunda Garred & Brucker

(57) ABSTRACT

There is provided a dock having a pair of primary frame members and a pair of secondary frame members. A plurality of cross members extends between the pair of primary frame members. The dock includes a plurality of cross member connectors for connecting the cross members to the primary frame members. Each cross member connector includes a frame contact portion and a cross member engagement portion extending from the frame contact portion. The frame contact portion is connected to a respective one of the plurality of primary frame members. The cross member engagement portion defines a channel sized and configured to receive the alignment plate of a respective one of the plurality of cross members. A roller assembly may also be included for stabilizing the dock relative to an adjacent piling.

15 Claims, 20 Drawing Sheets

OTHER PUBLICATIONS

Mod-U-Dock Modular Boat Docks; Website Article; http://www.modudock.com; (7 pages).
Piers, Docks; Website Article; http://www.aqualandmfg.com; (3 pages).
Borel Docks—Marine Construction; Website Article; http://www.boreldocks.com; (2 pages).
Florida Pier Construction; Website Article; http://www.dalesmarine.com; (1 page).
Information About Docks and Sea Walls; Website Article; http://www.innerbanks.biz; (2 pages).
GatordDock: Floating Docks; Website Article; http://www.cmiwaterfront.com; (2 pages).
Boat Docks; Website Article; http://www.waterventures.net; (2 pages).
SteelDeck an Enviornmentally Sound, Lifetime Surface for your Dock; Website Article; http://premiermaterials.com; (2 pages).
Connect-a-Dock Construction; Website Article; http://lakemarineconstruction.com; (7 pages).
EZ Docks; Website Article; http://tmpmarine.com; (2 pages).
Candock Floating Dock System; Website Article; http://tmpmarinecom; (2 pages).
Shoremaster Waler System Concrete Floating Docks; Website Article; http://tmpmarine.com; (4 pages).

* cited by examiner

DOCK SYSTEM

CROSS-REFERENCE TO RELATED APPLICATIONS

The present application is a continuation patent application of U.S. patent application No. 12,565,641, filed on Sep. 23, 2009 now U.S. Pat. No. 8,166,901 which is a continuation-in-part patent application of U.S. patent application Ser. No. 12/146,326, filed Jun. 25, 2008 now U.S. Pat. No. 7,640,881, the entire contents of which are incorporated herein by reference.

STATEMENT RE: FEDERALLY SPONSORED RESEARCH/DEVELOPMENT

Not Applicable

BACKGROUND

1. Field of the Invention

The present invention relates generally to a lightweight and durable ladder framed, skin-stressed structure typically formed of pultruded fiberglass materials joined with adhesives. The particular embodiments discussed herein are floating docks with a gangway leading from the shore or a pier. The floating portion of the system may be stabilized through the use of a piling stabilizing device and pontoons capable of improving the metacenter of the floating system which may enhance the utility of the subject dock, gangway, and pier embodiments of the subject ladder frame structure.

2. Description of the Prior Art

It is well-known that docks are man-made structures that extend from shore over a body of water. Docks are commonly employed to provide a walkway from the shore to a boat, which may be tethered to a post or piling adjacent the dock. In addition, docks may be used as a location to swim from, as well as a spot to relax and enjoy the nautical scenery.

It is common for water levels to fluctuate. For instance, the ocean tides cause the water levels to vary along an ocean coastline, and the release or retaining of water within a reservoir may also alter the reservoir's water level. Consequently, it may be desirable for docks to accommodate changes in the water level. One way docks commonly account for the changing water levels is to connect the dock to a float system. In this manner, as the water levels fluctuate, the dock remains floating on the surface of the water. A gangway may extend from the shore to the floating portion of the dock to provide a pathway thereto.

Many existing floating docks are constructed using a wood frame. The wood frame may be connected to an upper walking surface fabricated from a wood, concrete, or plastic material. Although wood is a commonly used construction material, it is very heavy compared to the weight of modern composite material. Thus, it may be problematic in relation to a floating dock. In particular, the wood may splinter, which may cause harm to anyone walking over the dock in their bare feet, which tends to occur when someone is swimming off of the dock. Furthermore, the screws or nails holding the wood together may protrude through the wood, thereby creating a safety hazard. The screws or nails may also fall out of the wood, which tends to weaken the structural integrity of the dock. In addition, the wood is liable to further structural weakening caused by termite infestation or rotting of the wood.

An additional drawback with most wood-framed docks is that they are typically custom-built for the specific user. In this manner, a considerable amount of time is spent designing and constructing the dock, which usually increases the cost thereof.

Another common material employed to construct floating docks is concrete. Although concrete is a regularly used construction material, there may be some drawbacks to using it to construct a floating dock, especially when the dock is used over a body of water having fluctuating water levels (i.e. ocean or reservoir). During low tide, portions of the concrete dock may come in contact with the shore, while other portions may remain floating. Consequently, the dock may be placed under stress, which may cause cracking in the concrete. If the concrete cracks, salt water may seep into the dock and weaken the structural integrity thereof.

Floating docks are also readily formed of a metallic material, particularly in freshwater conditions. Metallic floating docks are undesirable in saltwater because of corrosion problems. However, even in freshwater, metal docks may bend when the level of the water decreases to the point that the portions of the dock are resting on the shore, while other portions remain floating (as may be the case in a reservoir). Although the metal may have a certain amount of elasticity enabling the dock to reflex to a relatively straight configuration, if the dock bends beyond a certain point, the bend in the dock may be permanent.

Regardless of the material used to construct the floating dock, after construction, the floating dock is deployed in the body of water. The floating dock is typically restrained from movement to prevent the dock from floating away. A regularly used restraining technique is to design the dock to include a hole for allowing a piling to protrude therethrough. The pilings typically restrain the dock from floating away.

In rough conditions, waves may cause the dock to rise and fall along the pilings. Therefore, floating docks commonly include one or more rigid rollers to facilitate upward and downward movement of the dock relative to the piling. However, there is generally a small amount of clearance between the roller and the piling. Therefore, under rough conditions, the rollers may crash with the pilings, which typically results in banging and instability of the dock. Furthermore, the float systems connected to the docks are typically designed with the intention of simply keeping the dock floating, as opposed to enhancing the stability of the dock.

As is apparent from the foregoing, there exists a need in the art for an improved dock configuration. The present invention addresses this particular need, as will be discussed in more detail below.

BRIEF SUMMARY

There is provided a dock comprising a pair of primary frame members formed of a fiber-reinforced resin material, wherein the fibers may run parallel to each other and the longitudinal axis of the structural shape in which they are embedded. The pair of primary frame members extends parallel to a primary axis and are arranged in opposed, spaced parallel relation to each other. The dock further includes a pair of secondary frame members formed of a fiber-reinforced resin material, as described above. The pair of secondary frame members extends parallel to a secondary axis and are arranged in opposed, spaced parallel relation to each other. Each secondary frame member is connected to the pair of primary frame members. A plurality of cross members extends between the pair of primary frame members. Each cross member includes an upper platform contact face and an alignment plate extending generally perpendicularly from the upper platform contact face. The dock additionally includes a plurality of cross member connectors. Each cross member connector includes a frame contact portion and a cross member engagement portion extending from the frame contact portion. The frame contact portion is connected to a respective one of the plurality of primary frame members. The cross member engagement portion defines a channel sized and configured to receive the alignment plate of a respective one of the plurality of cross members.

The engagement between the cross member connector and the respective cross member may facilitate vertical orientation relative to the upper walking surface of the dock. In other words, the cross member connector may position the cross member for supporting the upper walking surface of the dock.

There may also be provided a roller assembly for use with a dock positioned near a piling. The roller assembly includes a spring biased bracket having a medial portion, a first distal portion and an opposing second distal portion. The first distal portion defines a first distal end and the second distal portion defining a second distal end. The medial portion is engageable with the dock. The first distal portion and the second distal portion are disposed on opposing sides of the dock plane when the medial portion is engaged to the dock. Each distal portion is moveable relative to the medial portion in a direction substantially parallel to the dock plane. An upper roller is rotatably connected to the first distal portion and is engageable with the piling. A lower roller is rotatably connected to the second distal portion and is engageable with the piling. The upper roller and lower roller are disposed on opposing sides of the dock plane when the spring biased bracket is engaged with the dock.

There may be provided another embodiment of a roller assembly for use with a dock positioned near a piling. The roller assembly may include an upper bracket having an upper dock portion and an upper roller portion. The upper dock portion is connectable to the dock upper surface. The upper roller portion is moveable relative to the upper dock portion. An upper roller is connected to the upper roller portion. The upper roller is engageable with the piling when the upper bracket is connected to the dock upper surface. The roller assembly further includes a lower bracket having a lower dock portion and a lower roller portion. The lower dock portion is connectable to the dock lower surface. The lower roller portion is moveable relative to the lower dock portion. A lower roller is connected to the lower roller portion. The lower roller is engageable with the piling when the lower bracket is connected to the dock lower surface.

The roller assemblies may be connected to the dock for maintaining the transverse and longitudinal stability of the dock.

The present invention is best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1A:
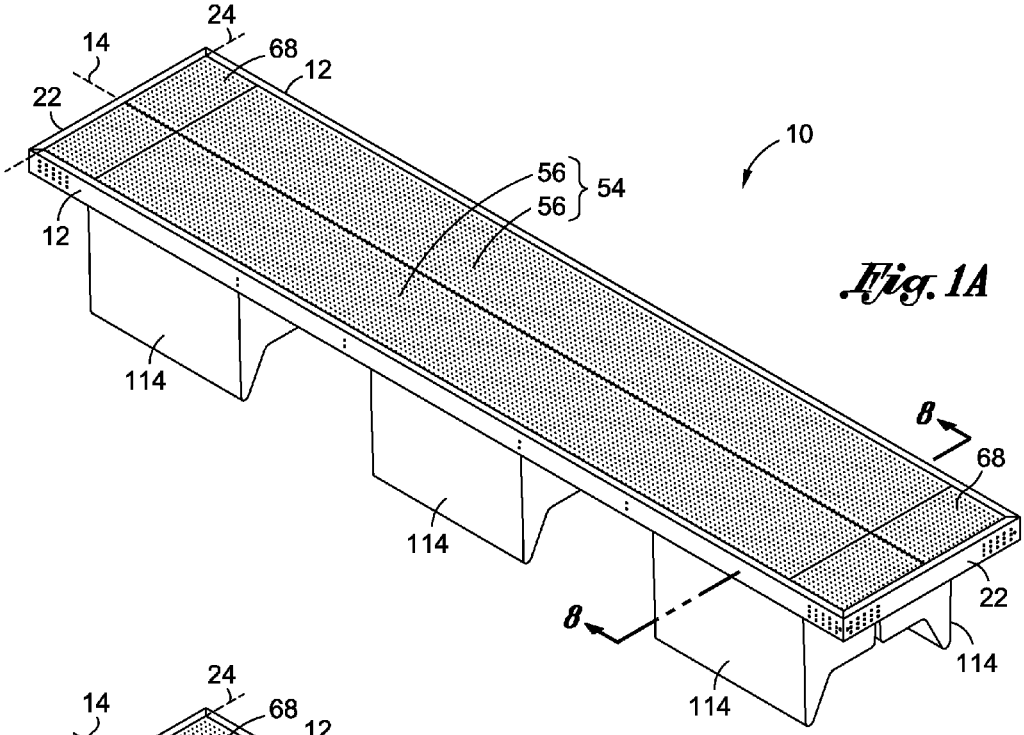
FIG. 1A is an upper perspective view of a dock constructed in accordance with an aspect of the present invention.

Referring now to the drawings where the showings are for purposes of illustrating a preferred embodiment of the present invention only, and not for purposes of limiting the same, there is shown a dock 10 constructed in accordance with an embodiment of the present invention. According to various embodiments of the present invention, the dock 10 includes a frame formed out of a pultruded material to provide a generally stronger and more durable dock 10 relative to existing docks.

Figure 1B:
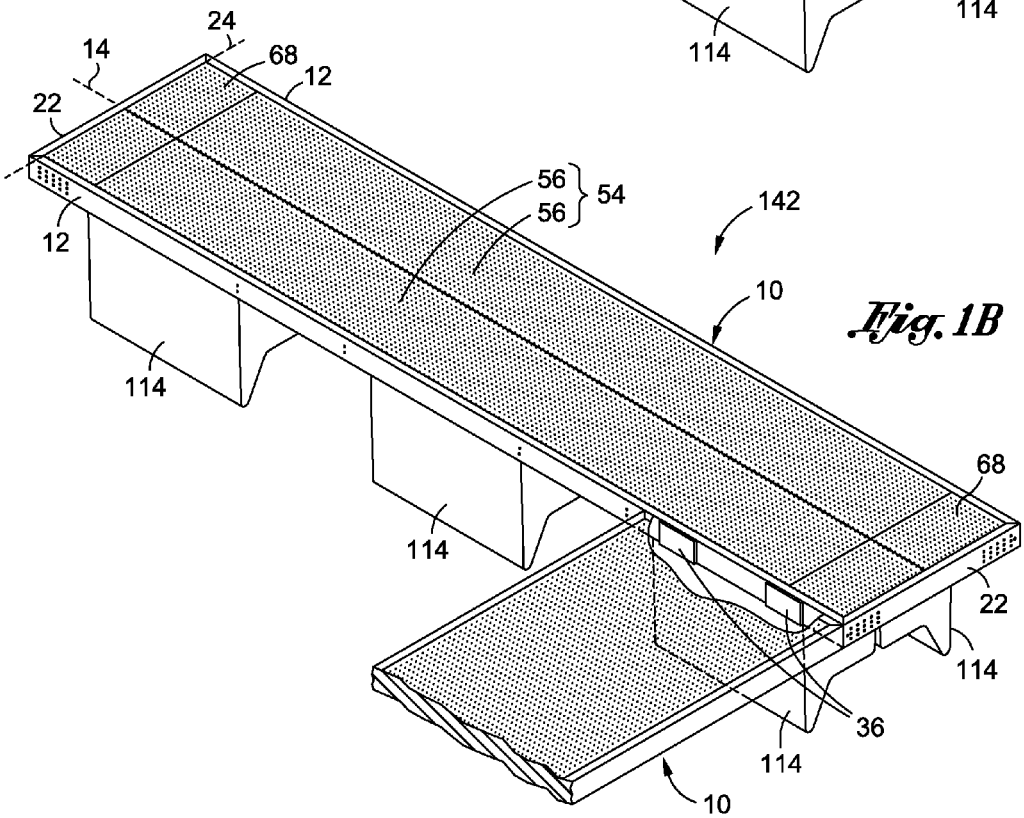
FIG. 1B is an upper perspective view of a dock assembly including two docks connected by a dock connector.
Figures 2, 2A, 2B:
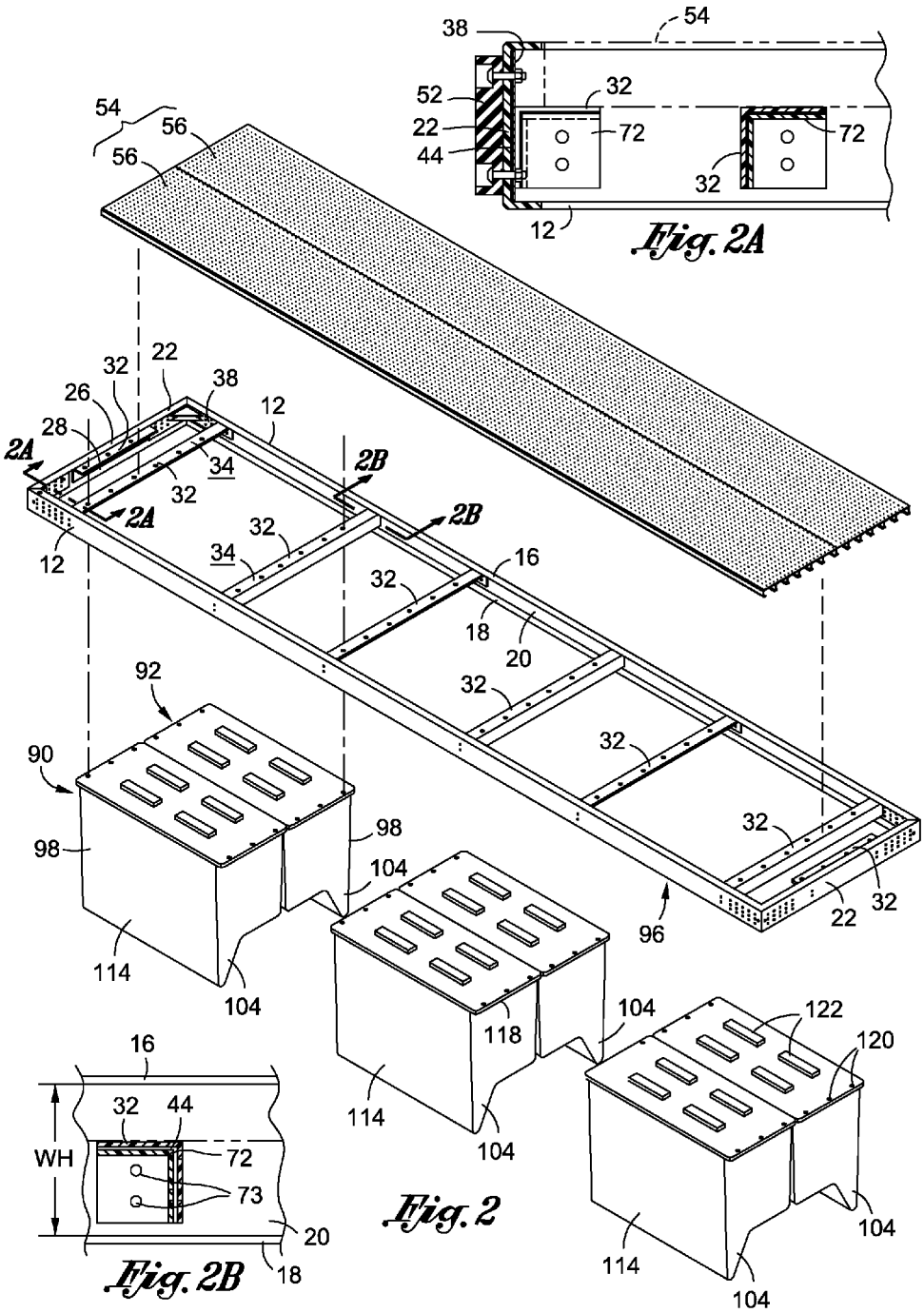
FIG. 2 is an exploded perspective view of the dock illustrated in FIG. 1A.
FIG. 2A is a side sectional view of an end portion of the dock illustrated in FIG. 2.
FIG. 2B is a side sectional view illustrating a cross member connector for connecting a cross member to a primary connector.
Figures 3, 4, 5:
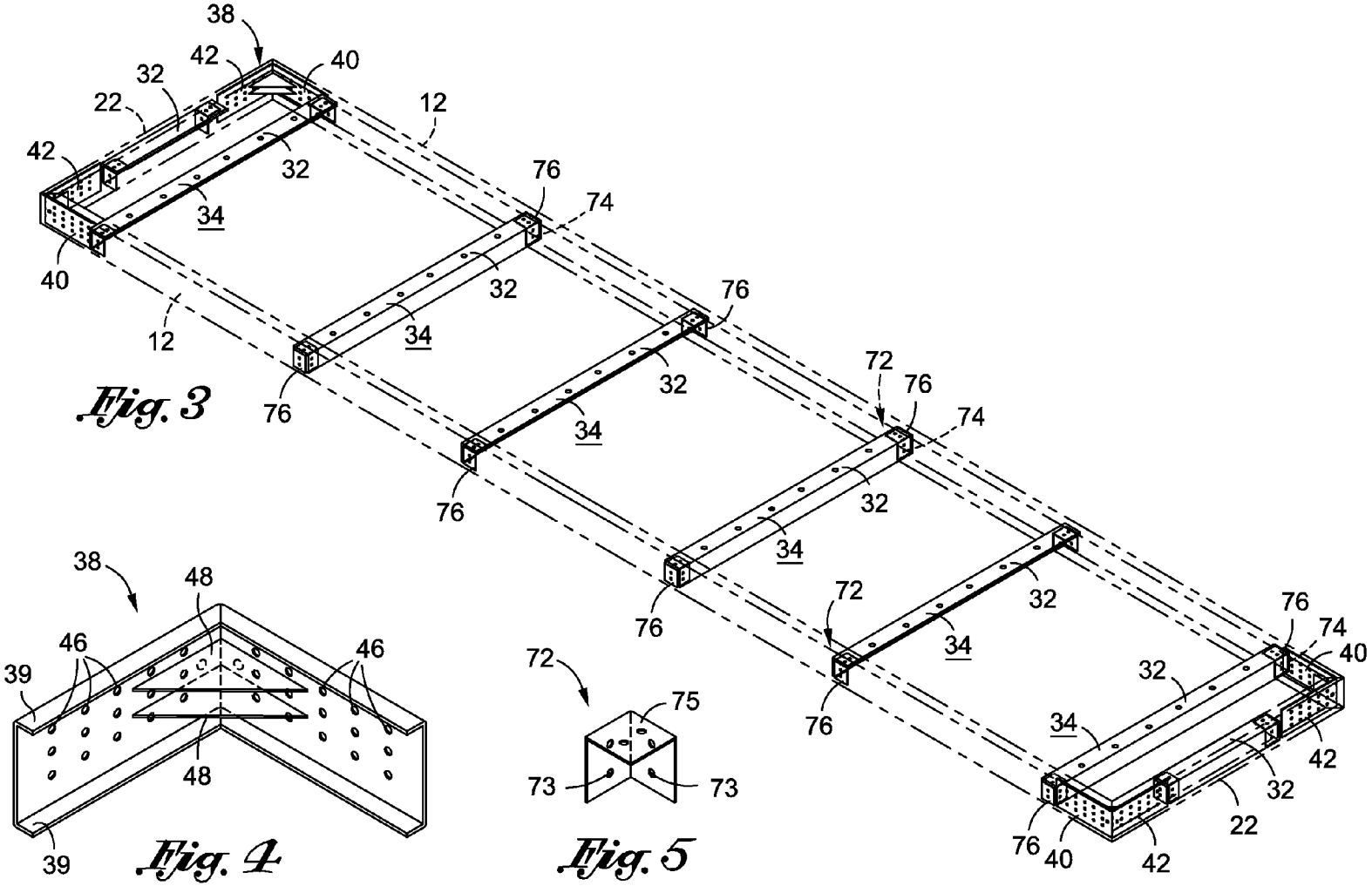
FIG. 3 is an upper perspective view of a plurality of cross members disposed between and connected to opposing primary frame members by the cross member connector, each primary frame member being connected to a pair of secondary frame members via a joint support.
FIG. 4 is an upper perspective view of the joint support.
FIG. 5 is an upper perspective view of the cross member connector.

Referring now to FIGS. 1-3, the dock 10 includes a pair of primary frame members 12 extending along a length thereof. According to one implementation, each primary frame member 12 includes a primary upper flange 16, a primary lower flange 18, and a primary wall 20 extending between the primary upper and lower flanges 16, 18. The primary wall 20 defines a wall height "WH" (See FIG. 2B) extending from the primary upper flange 16 to the primary lower flange 18. The primary frame members 12 extend along a primary axis 14 and are arranged in opposed, spaced parallel relation to each other. In this manner, the primary walls 20 of the respective primary frame members 12 may be facing each other.

The dock 10 also includes a pair of secondary frame members 22. In one embodiment, the secondary frame members 22 each include a secondary upper flange 26, a secondary lower flange 28, and a secondary wall extending therebetween. The secondary frame members 22 extend along a secondary axis 24 and are arranged in opposed, spaced parallel relation to each other. In this regard, the secondary walls of the respective secondary frame members 22 may be facing each other.

It may be desirable to form the primary frame members 12 and the secondary frame members 22 of a pultruded material. As used herein, a pultruded material is a material having one or more reinforcing fibers. Pultruded materials tend to be stronger, durable, and/or more lightweight than conventional dock materials (e.g. wood or metal). In one particular embodiment, the primary frame members 12 and the secondary frame members 22 are constructed of a fiber-reinforced resin material formed by a pultrusion process. The fiber-reinforced resin material may include, but is not limited to, fiber-reinforced fiberglass. Although the frame member 12, 22 are formed of pultruded materials in one embodiment, the frame members 12, 22 may be formed of extruded materials, or other materials known by those skilled in the art in another embodiments.

The primary and/or secondary frame members 12, 22 may be connected to a bumper 52 (See FIG. 2A) to mitigate damage caused by contact with a boat positioned adjacent the dock 10. The bumper 52 may be formed of a resilient material, such as rubber, capable of withstanding repeated contact with an adjacent boat.

In the embodiment shown in FIG. 1, the secondary frame members 22 are arranged orthogonally to the primary frame members 12. In other words, the secondary axis 24 is perpendicular to the primary axis 14. It is understood that other embodiments may include primary and secondary frame members 12, 22 that are arranged in a non-orthogonal configuration.

The secondary frame members 22 are connected to the primary frame members 12. More specifically, each secondary frame member 22 is connected to both primary frame members 12. Likewise, each primary frame member 12 is connected to both secondary frame members 22. The primary and secondary frame members 12, 22 may be connected to each other in abutting or non-abutting configurations. In other words, the primary and secondary frame members 12, 22 may be directly connected to each other, or an intermediate connection element may be used.

According to one embodiment, the primary and secondary frame members 12, 22 are connected via joint supports 38 (See FIG. 4). As best illustrated in FIG. 3, the dock 10 includes a joint support 38 disposed in each corner to connect adjacent primary and secondary frame members 12, 22. In one embodiment, the joint supports 38 are constructed of corrosion resistant steel. Each joint support 38 includes a primary joint face 40 that is connected to a respective primary frame member 12 and a secondary joint face 42 that is connected to a respective secondary frame member 22. The joint supports 38 shown in FIGS. 3 and 4 include primary and secondary joint faces 40, 42 arranged substantially orthogonally relative to each other. Consequently, when the primary and secondary frame members 12, 22 are connected to the joint support 38, the primary and secondary frame members 12, 22 are also arranged substantially orthogonal to each other. Therefore, if a non-orthogonal connection between the primary and secondary frame members 12, 22 is desired, a joint support 38 having primary and secondary joint faces 40, 42 arranged in a non orthogonal orientation may be used.

The joint supports 38 may also include a joint support flange 39. The joint support flange 39 may interface with the primary upper and lower flanges 16, 18 of the primary frame member 12, as well as the secondary upper and lower flanges 26, 28 of the secondary frame member 22 to provide additional structural support.

The joint support 38 may be connected to the respective primary and secondary frame members 12, 22 by a high-strength adhesive. In this manner, the adhesive is disposed between the primary joint face 40 and the respective primary frame member 12, as well as between the secondary joint face 42 and the secondary frame member 22. A mechanical fastener (not shown) may be used to temporarily connect the joint support 38 to the primary and secondary frame members 12, 22 while the adhesive cures.

The joint support 38 may also include a plurality of joint holes 46 as illustrated in FIG. 4. The joint holes 46 may be located in the primary joint face 40, the secondary joint face 42, as well as in the corner of the joint support 38. The adhesive disposed between the joint support 38 and the primary and secondary frame members 12, 22 may flow or ooze through the joint holes 46 when the joint support 38 is pressed against the primary and secondary frame members 12, 22 before the adhesive cures. The adhesive may be applied to the primary and secondary joint faces 40, 42 and/or the primary and secondary frame members 12, 22. When the joint support 38 is pressed against the respective primary and secondary frame members 12, 22, the adhesive may flow or ooze into the holes 46. In effect, the adhesive oozing through the holes 46 acts as a rivet or other mechanical fastener adding strength of multiple conventional fasteners to each joint. The oozing adhesive further enhances the strength of the connection in shear.

The primary and secondary frame members 12, 22 may be configured to support an upper surface for users to walk on. To this end, one embodiment of the dock 10 includes a plurality of cross members 32. Many of the cross members 32 are connected to and extend between the pair of primary frame members 12. More specifically, each of such cross members 32 includes opposing end portions that are connected to a respective primary frame member 12. The dock 10 may also include cross members 32 disposed adjacent the end portions of the dock 10 that are smaller in length than the intermediate cross members 32. In this regard, the cross members 32 disposed adjacent the end portion may not fully extend between the pair of primary frame members 12.

In the embodiment shown in FIG. 3, the cross members 32 are substantially orthogonal to the primary frame members 12. However, the cross members 32 may be disposed in a non-orthogonal orientation relative to the primary frame members 12 without departing from the spirit and scope of the present invention.

Each cross member 32 includes an upper platform contact face 34 disposed within a common upper platform contact plane. The upper platform contact faces 34 collectively form a support upon which an upper walking surface may be disposed. In this manner, it may be desirable that the upper platform contact faces 34 are substantially level to evenly support the upper walking surface.

The dock 10 may include a cross member connector 72 for connecting a respective cross member to one or more frame members 12, 22. Each cross member 32 may rest on the cross member connector 72, with no adhesive or fastener engaging the cross member connector 72 to the cross member 32. This may allow the cross member 32 to be easily removed from the cross member connector 72, which may be desirable to provide access to the underside of the dock 10, where utilities may be located. However, it is understood that other embodiments include an adhesive or fastener to secure the cross member 32 to the cross member connectors 72.

As shown in FIGS. 3 and 5, each cross member connector 72 includes a cross member contact face 74, a primary contact face 76, and a connector upper surface 75 extending between the cross member contact face 74 and the primary contact face 76. The primary contact face 76 is connected to a respective primary frame member 12. The cross member connector 72 may be connected to the primary wall 20 between the primary upper and lower flanges 16, 18. The cross member 32 may be disposed on two cross member connectors 72 connected to respective primary frame members 12. More specifically, the cross member 32 may rest on the connector upper surfaces 75 of the cross member connectors 72.

In one embodiment, a high strength adhesive is used to join the cross member connector 72 to the respective cross member 32 and primary frame member 12. The high strength adhesive may be the same high strength adhesive used to connect the joint support 38 to respective primary and secondary frame members 12, 22. A mechanical fastener may be used to temporarily connect the cross member connector 72 to the cross member 32 and the primary frame member 12 while the high strength adhesive cures. The cross member connector 72 may include one or more cross member holes 73 similar to the joint holes 46 in the joint support 38, as described above. The adhesive may be caused to be disposed within the cross member holes 73 to enhance the connection between the cross member connector 72, the cross member 32, and the primary frame member 12. Although the foregoing describes use of an adhesive to connect the cross member connector 72 to the cross member 32 and the primary frame member 12, it is understood that other fasteners known by those skilled in the art may also be used.

Referring now to FIGS. 19-22, there is shown a second embodiment of a cross member 232 as well as a second embodiment of a cross member connector 272 for connecting the cross member 232 to the primary frame member 12. The cross member 232 includes a cross member wall 234 and a cross member flange 236 extending generally orthogonally from the cross member wall 234, to define a generally "T" shaped cross section (compared to the generally "L" shaped cross section depicted in the embodiment described above). It is contemplated that other embodiments of the cross member 232 may include a pair of cross member flanges 236 disposed on opposed end portions of the cross member wall 234 to define a generally "I" shaped cross section.

The cross member connector 272 includes a connector wall 274 defining a wall inner face 276 and a wall outer face 278. A connector upper flange 280 and a connector lower flange 282 extend generally orthogonally from the connector wall 274 to define a "C" shaped cross section. The cross member connector 272 is disposable adjacent the primary frame member 12, with the connector upper flange 280 being disposed adjacent the primary upper flange 16, the connector wall 274 being disposed adjacent the primary wall 20, and the connector lower flange 282 being disposed adjacent the primary lower flange 18 (See FIG. 20).

The cross member connector 272 further includes a pair of cross member engagement elements 286 configured to engage with the cross member 232. The cross member engagement elements 286 include a connector tab 288 connected to the connector wall inner face 276. A first engagement wall 290 and second engagement wall 292 extend generally orthogonally from the connector tab 288, with the first engagement wall 290 being generally orthogonal to the second engagement wall 292. The pair of cross member engagement elements 286 are disposed in spaced relation relative to each other to define a cross member channel 294 therebetween. The cross member engagement elements 286 are arranged such that the first engagement walls 290 extend away from each other.

The cross member engagement elements 286 are configured to support the cross members 232. A cross member wall 234 from a respective cross member 232 is disposed within the cross member channel 294, and the cross member flange 236 is disposed adjacent the first engagement walls 290. In this regard, the cross member 232 may be secured between the pair of cross member engagement elements 286 to provide enhanced lateral support to the cross member 232.

The cross member engagement elements 286 may be spaced from the connector upper flange 280 by a distance "H" to provide suitable clearance needed for the deck material 285 (as discussed below).

Figure 21:
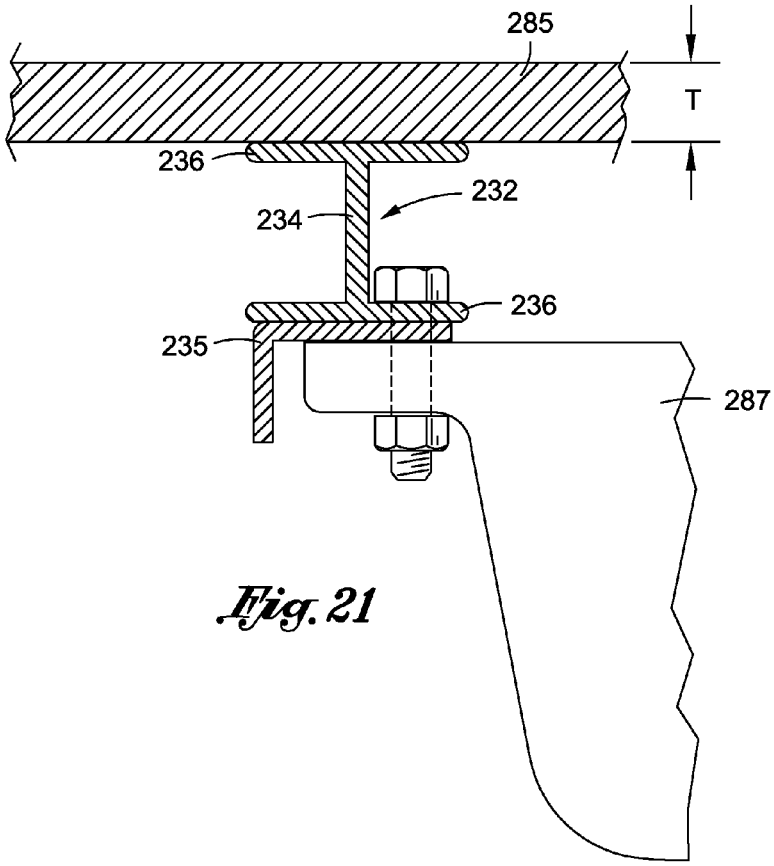
FIG. 21 is a sectional view of the second embodiment of the cross member connector fastened to a float with a thin dock section disposed on the cross member connector.
Figure 22:
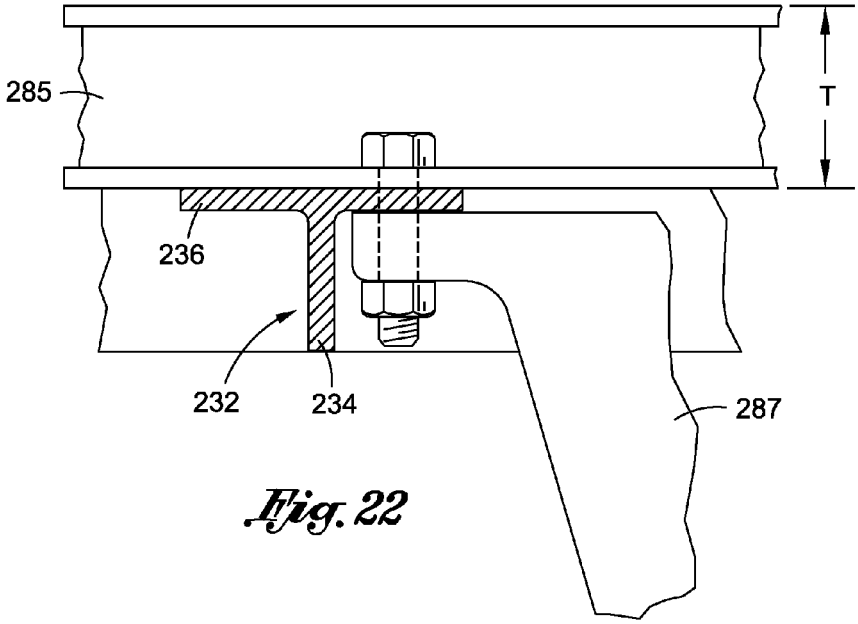
FIG. 22 is a sectional view of the second embodiment of the cross member connector fastened to a float and a thick dock section.

Referring now to FIGS. 21 and 22, the cross members 232 may be used to support deck materials 285 which may vary in thickness, "T." In the embodiment depicted in FIG. 21, an "I"

shaped cross member 232 is used to support a relatively thin deck material 285, whereas the cross member 232 illustrated in FIG. 22 is "T" shaped and supports a thicker deck material 285, relative to the deck material 285 depicted in FIG. 21. The cross members 232 may also be connected to a dock float 287, as described in more detail below. Conventional fastening means known by those skilled in the art may be used to connect the cross member 232 to the deck material 285 and/or the float 287. An "El" bracket 235 is used in FIG. 21 to connect the float 287 to the cross member 232.

Referring back to FIG. 19, the cross member connector 272 may include a plurality of holes 284 formed therein for securing the cross member connector 272 to the primary frame member 12. The holes 284 may be formed in the connector wall 274, upper flange 280 and/or lower flange 282. A high-strength adhesive may be used to secure the cross member connector 272 to the primary frame member 12. The adhesive may be disposed between the connector 272 and primary frame member 12 and "seep" through the holes 284 to strengthen the bond between the connector 272 and primary frame member 12. It is also understood that other mechanical fasteners known by those skilled in the art may also be used without departing from the spirit and scope of the present invention.

Although the cross members 32, 232 may be used to support an upper walking surface, additional support for an upper walking surface may be provided by the joint support 38. Referring again to the join support 38 depicted in FIG. 4, various embodiments of the joint support 38 may include a joint platform contact face 48 for providing such additional support. As shown, the joint platform contact face 48 extends between the primary and secondary joint faces 40, 42. Although a pair of joint platform contact faces 48 are shown in the joint support 38 depicted in FIG. 4, only one of the joint platform contact faces 48 may support an upper walking surface; however the pair of joint platform contact faces 48 makes the joint support 38 universal and disposable within any corner of the dock 10, as described in more detail above. When the joint support 38 is disposed within a respective corner of the dock 10, the upper joint platform contact face 48 is disposed within the common upper platform contact plane.

The dock 10 may include an upper platform 54, as shown in FIGS. 1, 2, 6A and 6B. The upper platform 54 includes an upper walking portion 58 and a lower contact element 60 that is disposable in contact with the upper platform contact faces 34 of the cross members 32. The upper platform 54 may be connected to each upper platform contact face 34 by double backed adhesive tape 70. Furthermore, the lower contact element 60 may also be disposable in contact with the joint platform contact face 48 for additional support.

It is contemplated that a large upper platform 54 may be required to provide an upper walking surface for a single dock 10. Therefore, the upper platform 54 may include one or more upper platform elements 56. The upper platform elements 56 collectively define the upper platform 54. It is understood that upper platform elements 56 that vary in size may be used to form the upper platform 54. In this manner, various upper platform elements 56 may be used which vary in length and width in order to accommodate the desired dimensions of the user.

Figure 6A:
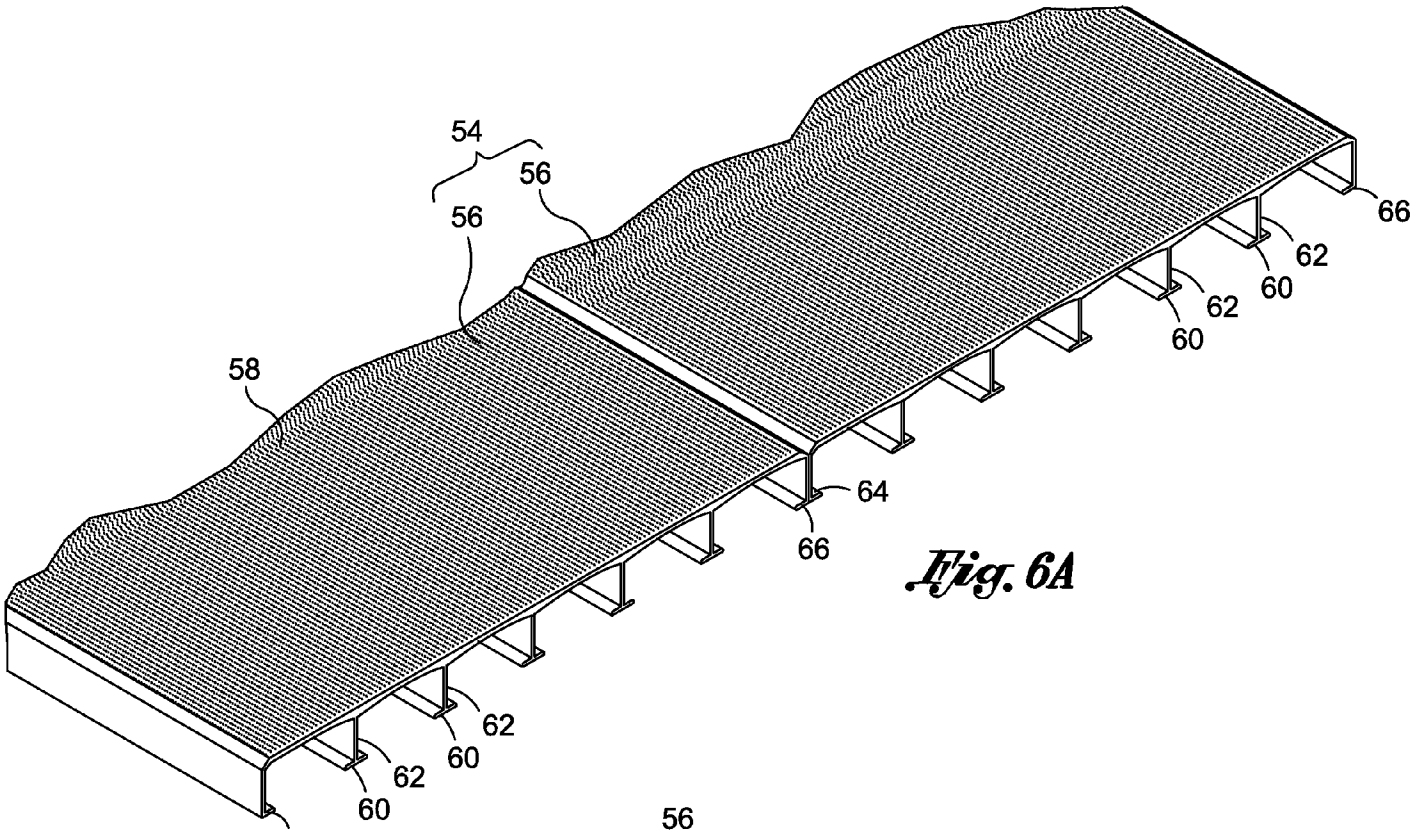
FIG. 6A is an upper perspective view of a portion of an upper platform, the upper platform including two upper platform elements.
Figure 6B:
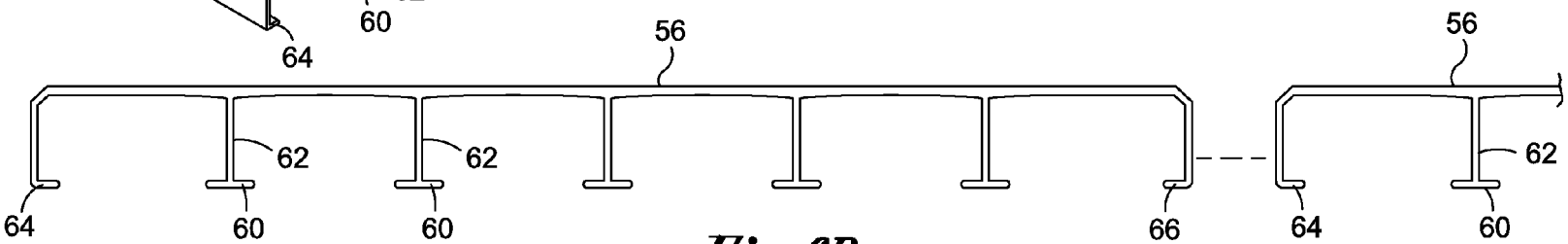
FIG. 6B is a side view of the upper platform elements.

In the embodiments shown in FIGS. 6A and 6B, each upper platform element 56 includes a plurality of upper platform ribs 62 extending from the upper walking portion 58 and terminating in a respective lower contact element 60. As illustrated, the upper platform ribs 62 extend generally orthogonally from the upper walking portion 58 with the lower contact element 60 being disposable in contact with the cross members 32. Each lower contact element 60 may be connected to one or more cross member 32 by double backed adhesive tape or other adhesives or mechanical fasteners. In this regard, each lower contact element 60 may extend along the length of the upper platform element 56 to connect with multiple cross members 32. As such, each upper platform element 56 may be connected to a plurality of cross member 32 to create a monocoque construction of the upper platform 54 to enhance the structural integrity thereof. In other words, each upper platform element 56 supports adjacent upper platform elements 56 to improve the overall rigidity and strength of the upper platform 54.

According to one implementation of the invention, the upper platform 54 is formed of a fiber-reinforced resin material and is formed by a pultrusion process. In addition, it is also contemplated that the cross members 32 may also be formed of a fiber-reinforced resin material that may be pultruded. However, the upper platform 54 and cross members 32 may also be formed of extruded materials, or other materials known by those skilled in the art.

It is contemplated that the upper platform 54 may include one or more removable end pieces 68 to allow access to items underneath the upper platform 54. The embodiment illustrated in FIG. 1 includes four removable end pieces 68 disposed adjacent the end portions of the dock 10 (the embodiment shown in FIG. 2 does not include removable end pieces 68). In one embodiment, the removable end pieces 68 are connected to joint support 38 and/or cross member 32 by commercial post and post double backed tape or other mechanical fasteners. One supplier of post and post double backed tape is the 3M Company headquartered in Maplewood, Minn. In another embodiment, the removable end pieces 68 simply rest on a support, such as the joint support 38 and/or cross member 32, without being fixedly connected thereto to enable easy removal thereof.

Figure 7:
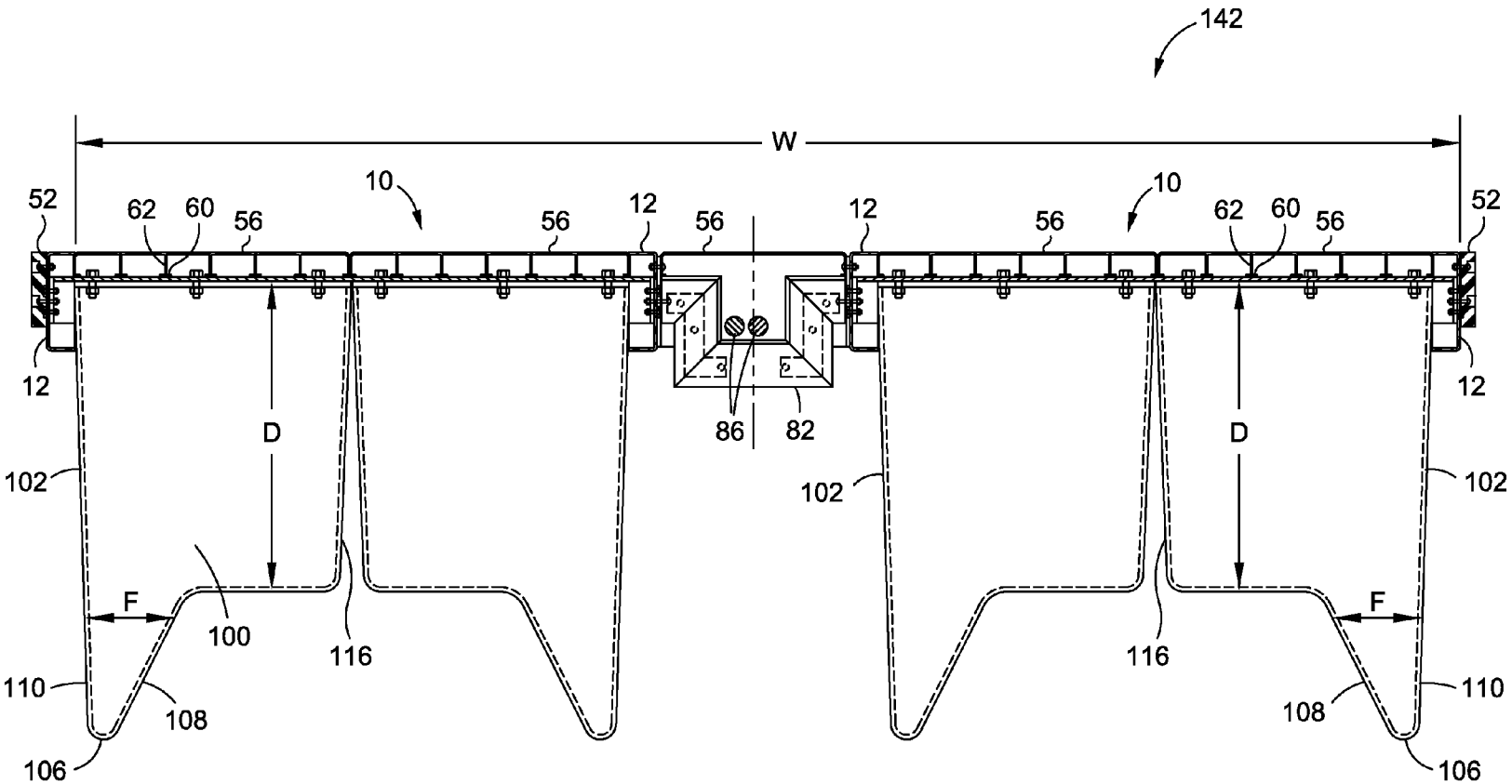
FIG. 7 is an end view of an embodiment of the dock assembly, wherein adjacent docks are connected by a medial connector.

It is common for utilities 86 to extend under a dock 10 (See FIG. 7). Such utilities 86 may include, but are not limited to, potable water, sewage, fire water, electricity, cable and telephone services. Therefore, one embodiment of the present invention includes a dock assembly 142 including a pair of adjacent docks 10. The docks 10 are connected by a medial connector 82 sized and configured to provide a channel for utilities 86. The medial connector 82 may be connected to a opposing frame members 12, 22 of the adjacent docks 10. In particular, the medial connector 82 may be connected to opposing primary frame members 12 on docks 10 connected side-by-side.

The medial connector 82 may also be desirable in docks 10 having a large dock width "W." (See FIG. 7) As used herein, the dock width W is equal to the distance between the primary frame members 12. A greater width W may be achievable by connecting a pair of docks 10 together via a medial connector 82. However, other connection means may also be used, as described in detail below.

According to another aspect of the present invention, the dock 10 is modular to allow for easy assembly thereof. To this end, many of the components may be prefabricated to enable on-site assembly of the dock 10. A modular dock generally requires less time to assemble, and is cheaper to manufacture and transport. In one particular embodiment, the primary frame member 12, secondary frame member 22, cross members 32, and upper platform elements 56 may be formed of standard dimensions. The components may be available to construct a dock 10 that is 20'×3', 20'×4', 20'×6', and 20'×8'. Such standard dock sizes are exemplary in nature and are not intended to limit the scope of the present invention. Although the foregoing describes a module dock design, it is also understood that a custom dock 10 having dimensions that differ from the standard sizes may also be constructed without departing from the spirit and scope of the present invention.

Although the foregoing discussion relates to various embodiments of a dock frame, it is understood that other embodiments may be used as a ladder-shaped support structure for a wide range of applications. For instance, the ladder-shaped support structure may be used in residential and commercial construction applications, as well as other applications known by those skilled in the art. In this regard, the frame members 12, 22, cross members 32, 232, joint supports 38, and cross member connectors 72, 272 are not limited to dock applications.

Figure 8:
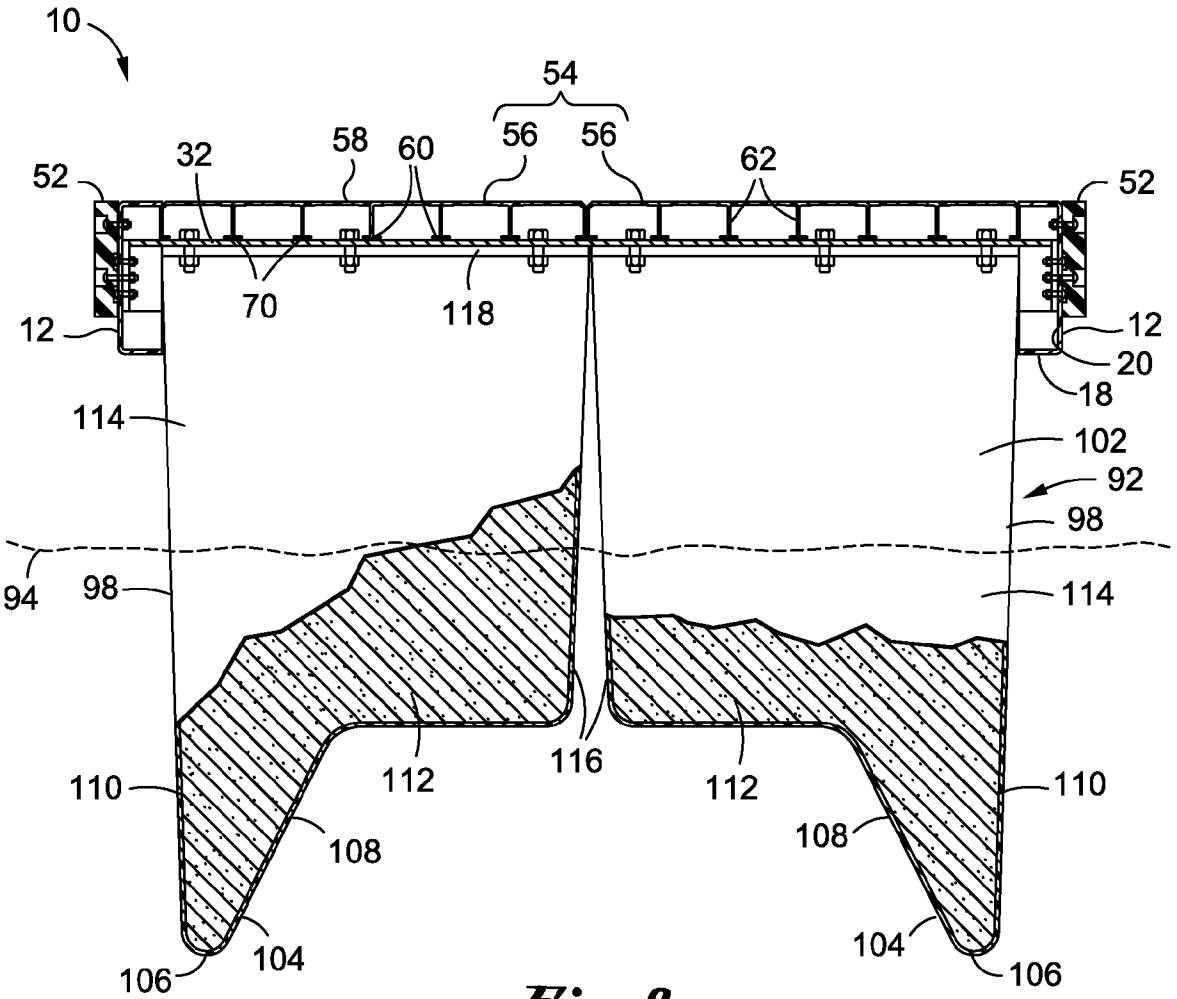
FIG. 8 is a side sectional view of the dock having a float system including a pair of floatation elements, each floatation element having a floatation fins extending from a lateral portion thereof.

Referring now to FIGS. 7-8, various aspects of the present invention are directed toward a float system 90 for use with the dock 10. The float system 90 is intended to provide a buoyant force to the dock 10 to keep the upper walking portion substantially above the body of water 94. The float system 90 includes a floatation shell 92 that is disposable beneath a water facing surface 96 of the dock 10. In one particular embodiment, a low density polyurethane foam is used to cast the basic shape of the floatation shell 92. After curing for a few seconds, the floatation shell 92 is sheathed with a high density polyurethane skin. In another embodiment, the floatation shell 92 is formed of a polyethylene sheath containing an expanded polystyrene core.

The floatation shell 92 includes a shell base 102 having a shell base upper surface 103. A pair of opposing floatation fins 104 extends away from the shell base 102 to define respective fin distal portions 106. The distance between the shell base upper surface 103 and the fins 104 is referred to as the shell depth "D." (See FIG. 7) The size of the shell depth D may vary as desired. According to various aspects of the present invention, the shell depth D is deepest at the fin distal portions 106. It may desirable that the floatation fins 104 extend from opposing lateral portions 98 of the floatation shell 92 to increase the stability of the dock 10.

As can be seen from the illustration in FIG. 8, the floatation fins 104 extend from the shell base 102 toward the water 94. Each floatation fin 104 includes a fin medial face 108 and a fin lateral face 110 to define a fin width "F" therebetween. (See FIG. 7) The floatation fin 104 is configured such that the fin width F decreases from the shell base 102 towards the fin distal portion 106. In other words, the fin width F is the smallest at the fin distal portion 106. It is understood that the fin width F may decrease in a uniform or non-uniform manner.

The size and configuration of the floatation shell 92 may be varied to accommodate various weights and dock configurations. For instance, the shell depth D may be increased to provide more buoyancy for a heavier dock. In addition, by altering the shell depth D, the freeboard height may also be altered. As used herein, the freeboard height refers to the distance between the water level and the upper platform 54. In addition to altering the shell depth D, the fin width F may also be altered to enhance the lateral stability of the dock 10.

In the particular embodiment shown in the FIG. 8, the floatation shell 92 includes a pair of floatation elements 114, which collectively define the floatation shell 92. Each floatation element 114 includes a floatation medial face 116 and a floatation lateral face 117. The floatation medial faces 116 of the respective floatation elements 114 are disposed in opposed relation to each other, as best shown in FIG. 8. In this manner, the floatation fins 104 are disposed laterally of the floatation medial face 116.

The floatation shell 92 also defines a floatation cavity 100. According to one embodiment, a buoyant element 112 is disposed within the floatation cavity 100 to enhance the buoyancy of the float system 90. The buoyant element 112 may be constructed out of a foam material, or other buoyant materials known by those skilled in the art.

According to one particular implementation, the floatation shell 92 includes an attachment flange 118 connected to the floatation shell 92. In this manner, the attachment flange 118 may extend from the floatation shell 92. The attachment flange 118 includes one or more fastener openings 120 extending therethrough. The fastener openings 120 may be aligned with openings on the dock 10 to allow a mechanical fastener, such as a bolt to extend therethrough, to attach the floatation shell 92 to the dock 10. As shown in the exploded view in FIG. 2, the fastener openings 120 of the attachment flange 118 are aligned with openings within the cross member 32 of the dock 10.

Although the Figures show a nut and bolt connector for attaching the floatation shell 92 to the dock 10, it is also understood that other fasteners may also be used to attach the floatation shell 92 to the dock 10. For instance, the dock 10 may include a spring biased locking member which may engage with the fastener openings 120 to connect the floatation shell 92 to the dock 10. Alternatively, the floatation shell 92 may include a flange which is engaged within a groove formed within the dock 10 for attachment thereto.

The embodiment in FIG. 2 also shows a floatation shell 92 having a plurality of press-fit engagement members 122 extending from the shell base 102. The press-fit engagement members 122 may be configured to engage with the dock 10. The dock 10 may include a dock engagement member that engages with the press-fit engagement member 122. In one implementation, the press-fit engagement members 122 may engage with the upper platform 54. More specifically, individual engagement members 122 may be received between adjacent upper platform ribs 62 to secure the floatation shell 92 to the dock 10.

Figure 8A:
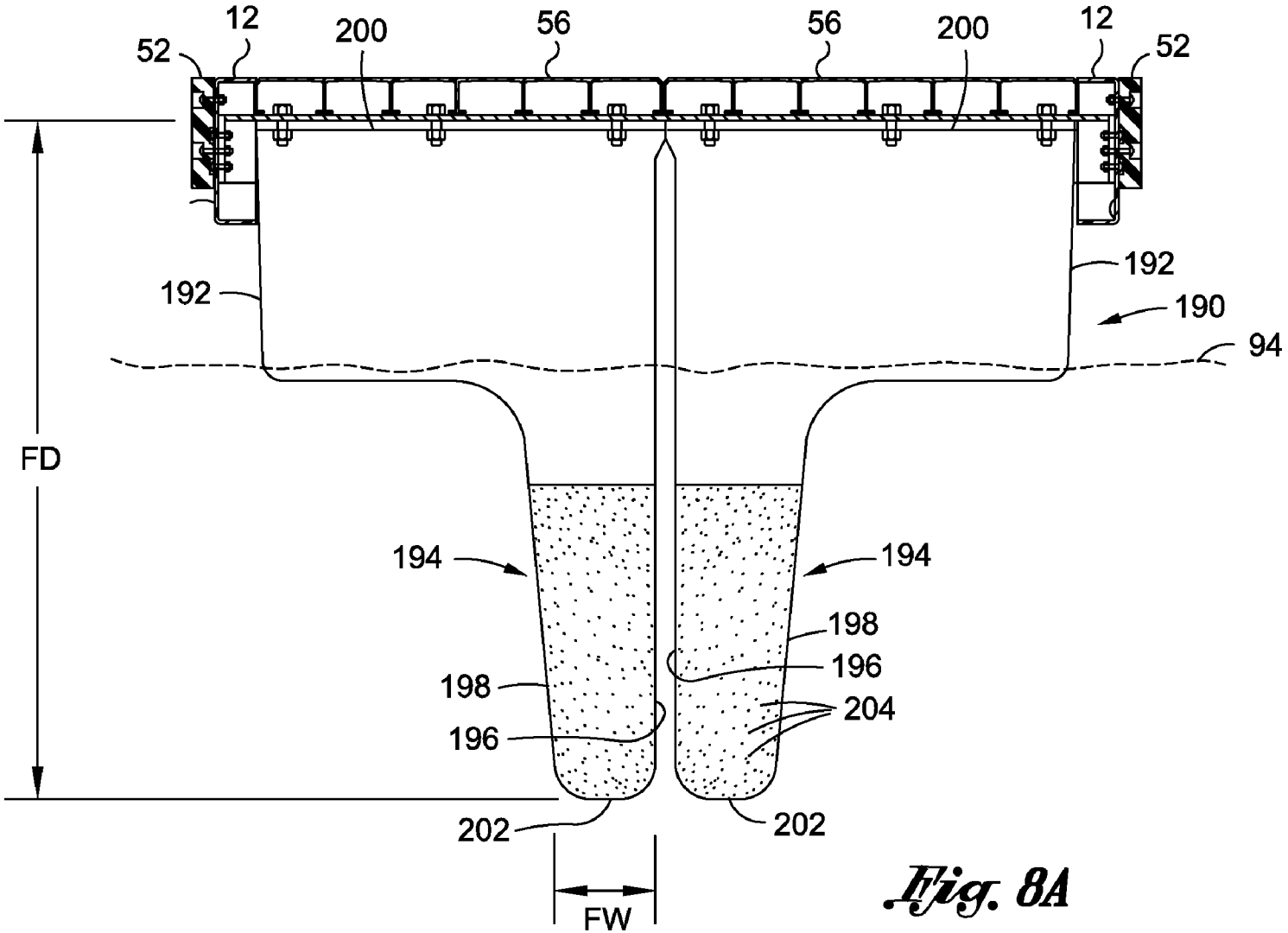
FIG. 8A is a side sectional view of the dock having another embodiment of the float system connected thereto, the float system including a pair of floatation elements, each floatation element having a medial fin filled with sand.

The floatation shell 92 depicted in FIG. 8 may be desirable for purposes of wave attenuation. Referring now to FIG. 8A, there is shown another embodiment of the floatation shell 190 which may be more desirable for creating a more stable walking surface. The floatation shell 190 includes a pair of floatation elements 192, each having a medial fin 194 terminating in a fin distal portion 202. In this manner, the fin 194 is disposed under the medial portion of the dock 10, as opposed to the lateral portion of the dock 10. Each floatation element 192 also includes a medial face 196, a lateral face 198 and an upper face 200. The distance between the medial face 196 and the lateral face 198 is referred to herein as the fin width, "FW," while the distance between the upper face 200 and the fin distal portion 202 is referred to as the fin depth, "FD." The fin width FW and fin depth FD may vary to achieve desired floatation characteristics.

The medial fin 194 may be filled with sand 204 or other material known in the art to provide additional weight to the medial fin 194. The additional weight provides more stability to the dock 10. The amount of sand 204 or other material may be varied according to the particular size and weight of the respective dock 10.

Figure 8B:
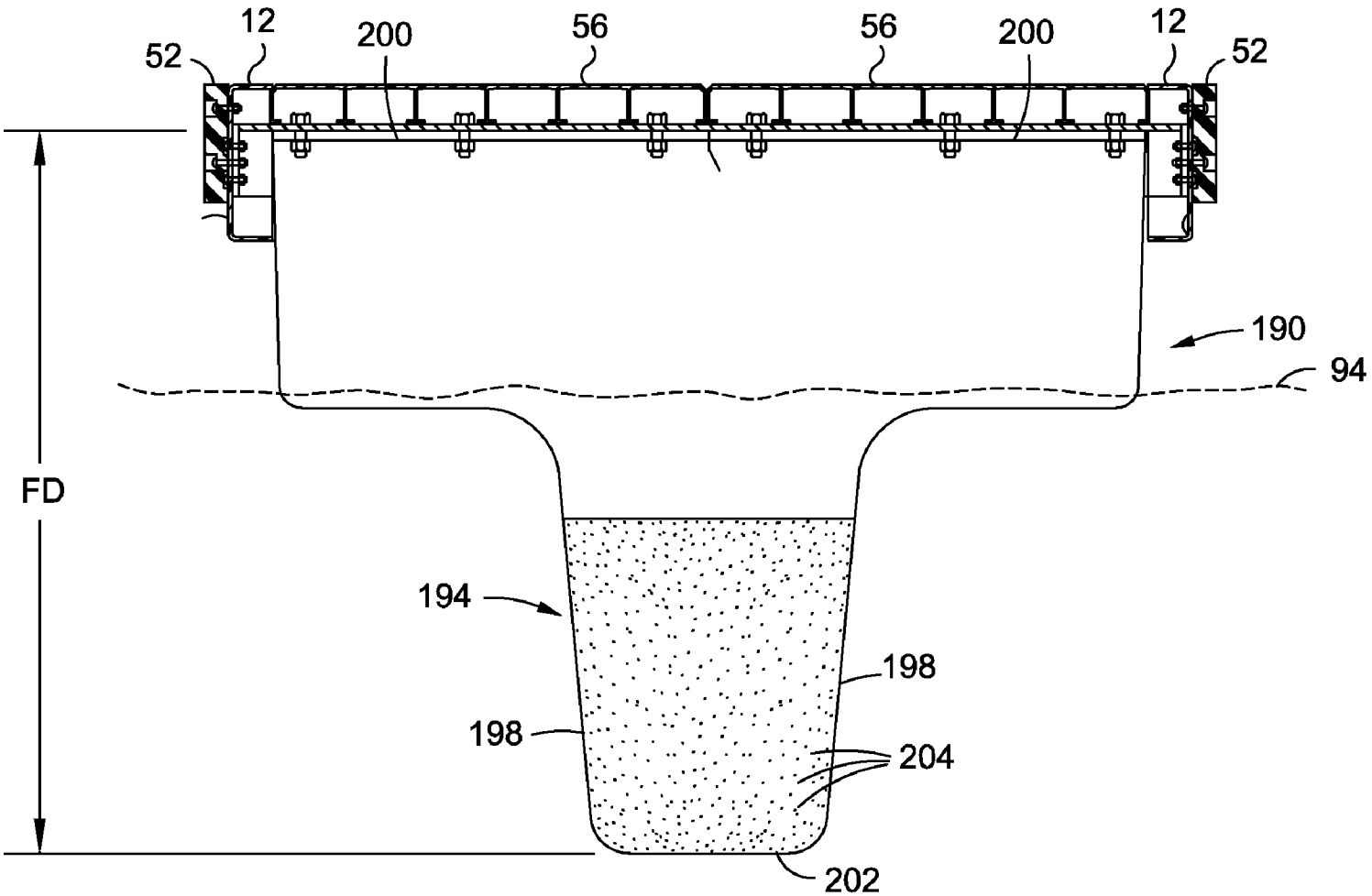
FIG. 8B is a side sectional view having a further embodiment of the float system connected thereto, the float system including a single floatation element.

The embodiment of the floatation shell 190 depicted in FIG. 8B is essentially a combination of the floatation elements 192 depicted in FIG. 8A. The floatation shell 190 includes a fin 194 disposed medially relative to the primary frame members 12 when connected to the dock 10. The fin 194 includes a fin distal portion 202 extending between a pair of lateral faces 198.

Figure 9:
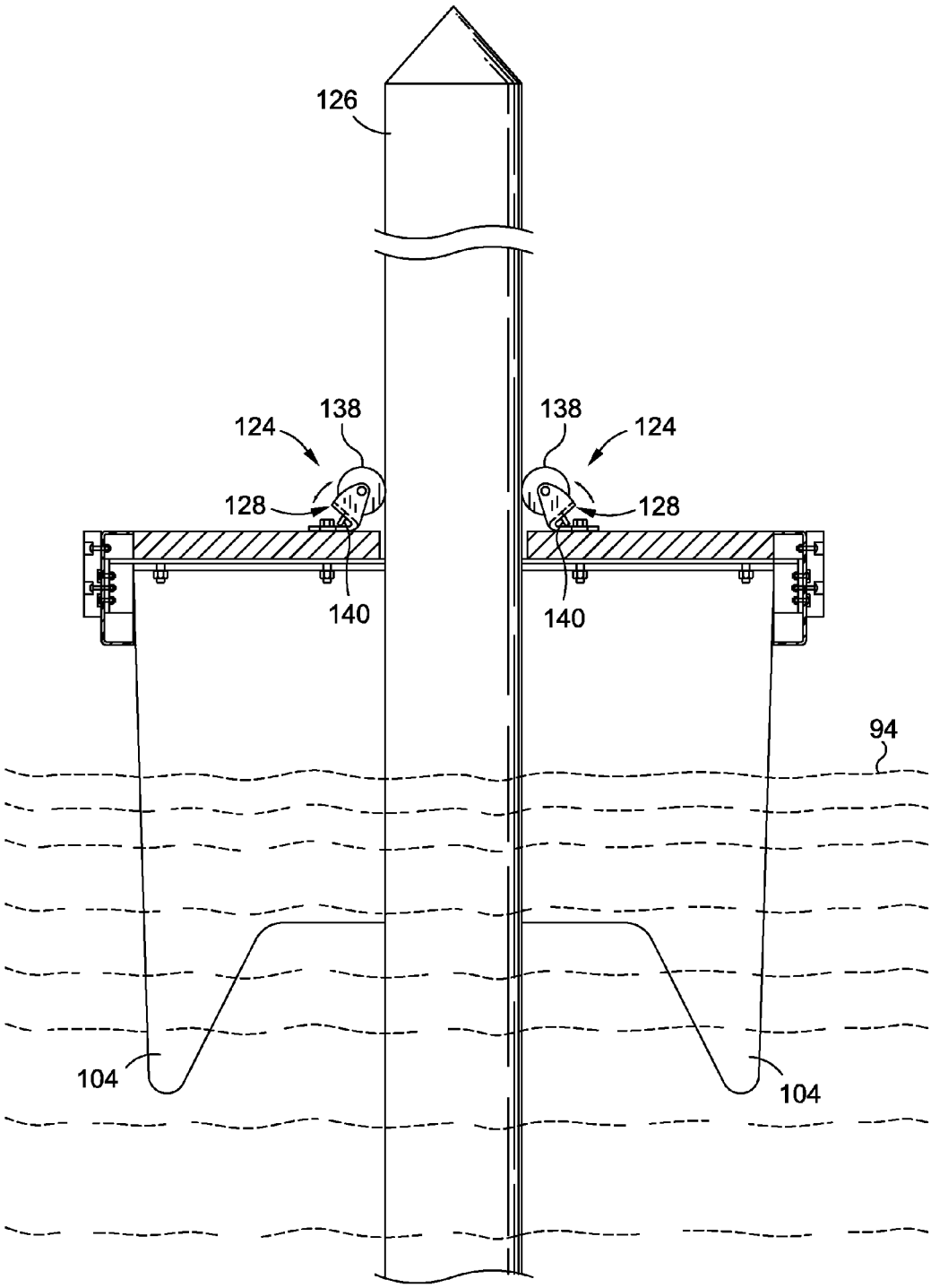
FIG. 9 is a side view of a dock having a pair of opposing roller assemblies engaged with a piling.

As the dock 10 floats in the body of water 94, it is typically restrained to maintain the dock 10 in a desired location. One common technique of restraining the dock 10 is to connect the dock 10 to one or more pilings 126 (See FIG. 9). In this manner, the dock 10 typically includes one or more a holes through which the pilings 126 protrude. Therefore, as the water currents urge the dock 10 away from its desired location, the protruding pilings 126 keep the dock 10 in place.

In rough water conditions, the dock 10 may traverse up and down the piling 126. The traversal of the dock 10 along the piling 126 may be very unsteady. Furthermore, the waves may cause the dock 10 to crash into the piling 126 under certain conditions, which generally creates a very unstable walking surface. Repeated contact between the dock 10 and the piling 126 may cause damage to the dock 10. Therefore, various aspects of the present invention include a roller assembly 124 for use on a dock 10 positioned near a piling 126. The roller assembly 124 may be configured to provide a smoother traversal of the dock 10 along the piling 126. In addition, the roller assembly 124 may act as a shock-absorber between the dock 10 and the piling 126.

Figure 10:
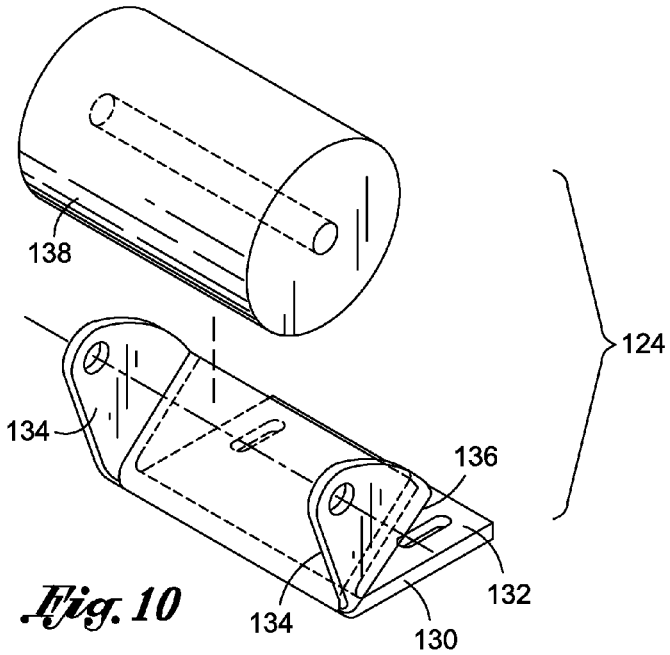
FIG. 10 is an exploded view of the roller assembly illustrated in FIG. 9.

The roller assembly 124 includes a spring biased bracket 128 having a dock contact portion 130 and a bracket sidewall 134 (See FIG. 10). The dock contact portion 130 is engageable with the dock 10 and includes a dock contact upper surface 132. In the embodiment illustrated in FIGS. 11A and 11B, the dock contact portion 130 is disposed in direct contact with the dock 10. The dock contact portion 130 is connected to the dock 10 via a mechanical fastener, such as a screw, nut and bolt, nails, or the like. It is also contemplated that the dock contact portion 130 may be integrally formed with the dock 10.

Figure 11A:
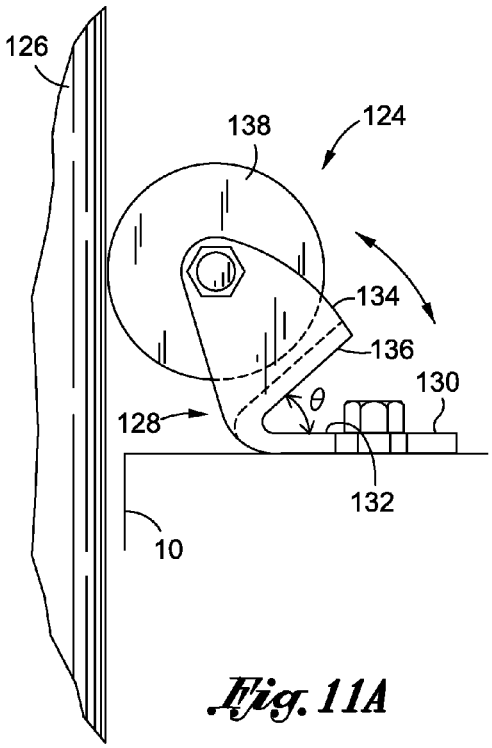
FIG. 11A is a side view of the roller assembly illustrated in FIG. 9 in a compressed position.
Figure 11B:
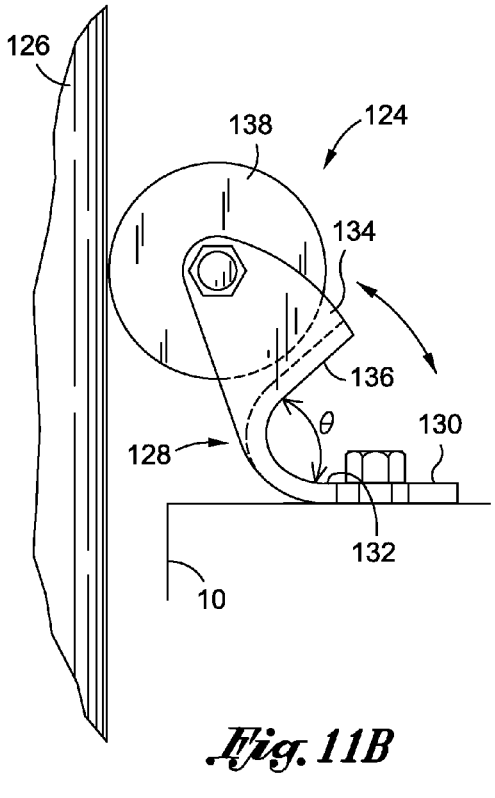
FIG. 11B is a side view of the roller assembly illustrated in FIG. 9 in an extended position.
Figure 12:
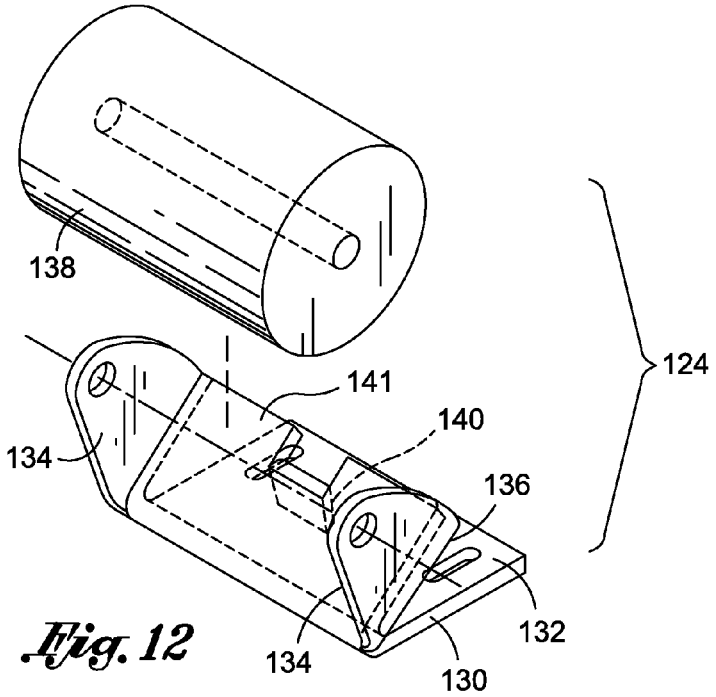
FIG. 12 is an exploded view of another embodiment of the roller assembly, wherein the roller assembly includes a roller bracket having a stop member to limit pivotal movement of the roller bracket.
Figure 13A:
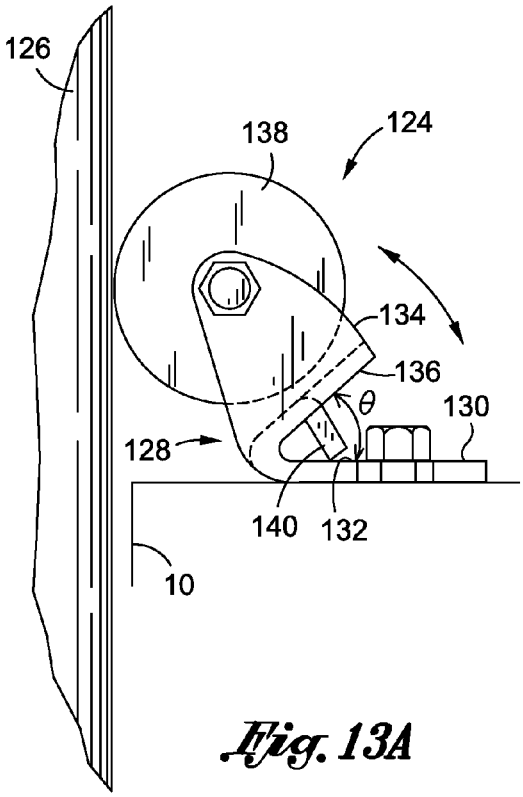
FIG. 13A is a side view of the roller assembly illustrated in FIG. 12 in a compressed position.
Figure 13B:
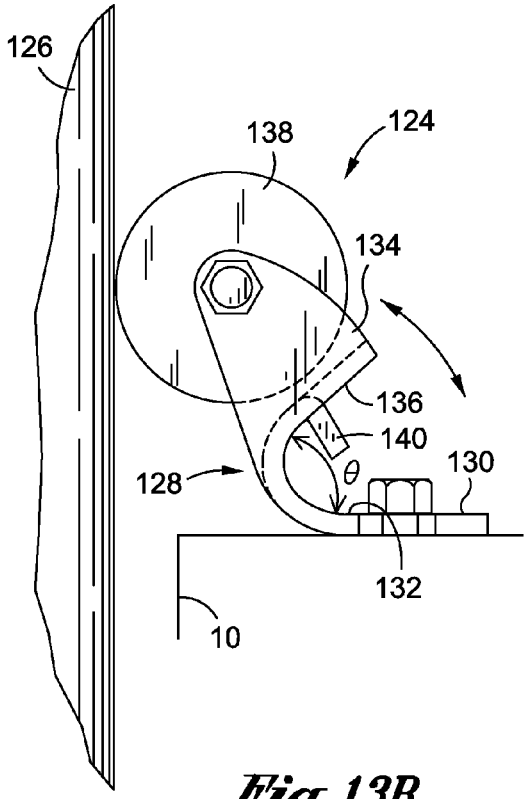
FIG. 13B is a side view of the roller assembly illustrated in FIG. 12 in an extended position.

When the dock contact portion 130 is engaged with the dock 10, the dock contact upper surface 132 faces away from the dock 10. In this manner, the dock contact upper surface 132 may be exposed and facing upwardly, away from the water. The mechanical fastener fastening the dock contact portion 130 to the dock 10 may be disposed in contact with the dock contact upper surface 132, as shown in FIGS. 11A and 11B.

The dock contact portion 130 is connected to the bracket sidewall 134. In one embodiment, the bracket sidewall 134 is integrally formed with the dock contact portion 130, as shown in FIGS. 11A and 11B. In another embodiment, the bracket sidewall 134 is detachably connected with the dock contact portion 130. In this manner, the bracket sidewall 134 may be removed from the dock contact portion 130, which may be desirable if the bracket sidewall 134 breaks.

The bracket sidewall 134 includes a sidewall lower edge 136. As shown in FIGS. 11A and 11B, the sidewall lower edge 136 is disposed along the end portion of the bracket sidewall 134 facing the dock contact portion 130. Furthermore, in the particular embodiment illustrated in the Figures, the bracket 128 includes a bend to dispose the bracket sidewall 134 at least partially over the dock contact portion 130. In this manner, the sidewall lower edge 136 and the dock contact upper surface 132 define a bracket angle, $\theta$.

The spring biased bracket 128 is moveable between a compressed position and an extended position. The bracket 128 may move between the compressed and extended positions to absorb impact between the dock 10 and the piling 126. The bracket angle $\theta$ increases as the spring biased bracket 128 moves from the compressed position to the extended position. The spring biased bracket 128 is biased towards the extended position. Therefore, when the dock 10 initially contacts a piling 126, the bracket 128 is likely in an extended position. As the dock 10 is urged toward the piling 126, the bracket 128 moves toward the compressed position and absorbs impact between the dock 10 and the piling 126 to provide a more stable dock 10.

Figure 14A:
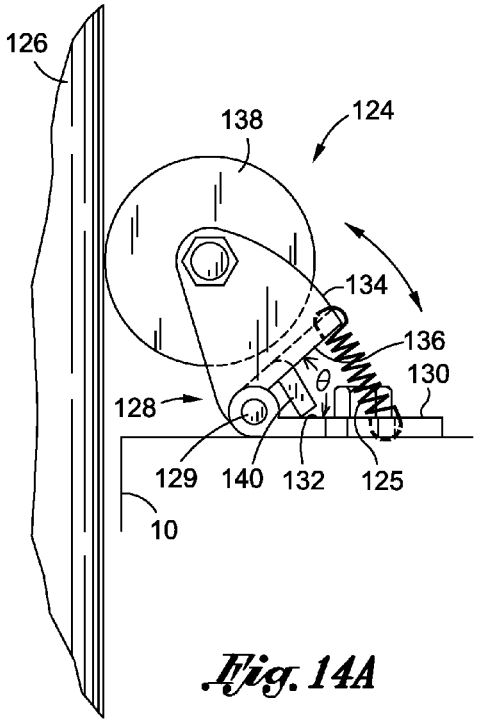
FIG. 14A is a side view of another embodiment of the roller assembly, wherein the roller assembly includes a coil spring connected to the bracket, the roller assembly being in the compressed position.
Figure 14B:
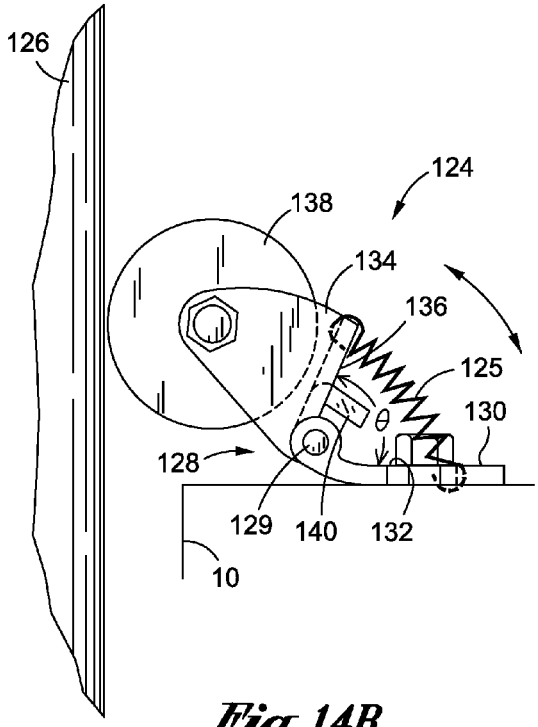
FIG. 14B is a side view of the roller assembly shown in FIG. 14A, the roller assembly being in the extended position.

The inherent physical properties of the bracket 128 illustrated in FIGS. 10, 11A, and 11B bias the bracket 128 toward the extended position. However, other embodiments may include additional biasing elements, such as a leaf spring, coil spring 125 (illustrated in FIGS. 14A and 14B), or other biasing mechanisms known in the art to provide additional biasing forces to the bracket 128. In embodiments where the biasing force is provided by an external element, such as a coil spring 125, the bracket 128 may include a bracket hinge 129 to enable pivotal movement of the bracket 128.

Referring now to the embodiments illustrated in FIGS. 12, 13A, 13B, 14A and 14B there is shown a bracket 128 having a stop member or lug 140 configured to limit the amount of movement between the compressed and extended positions. As shown, the stop member 140 extends from a bracket upper wall 141 toward the dock contact upper face 132. When the bracket 128 moves from the extended position toward the compressed position, the stop member 140 is brought closer to the dock contact upper face 132. Eventually, the stop member 140 is brought into contact with the dock contact upper face 132 to mitigate further movement in that direction. Although the stop member 140 is shown extending from the bracket upper wall 141, it is also contemplated that the stop member may extend from the dock contact upper face 132 toward the bracket upper wall 141.

The roller assembly 124 additionally includes a roller 138 rotatably connected to the bracket sidewall 134. In the particular embodiment shown in FIG. 10, the bracket 128 includes a pair of opposing bracket sidewalls 134 disposed on opposing sides of the roller 138. A rotation rod may extend through the roller 138 to allow the roller 138 to freely rotate thereabout. The rotation rod may be connected to the bracket sidewall(s) 134 by a mechanical fastener, such as a nut and bolt, or the like.

In operation, the roller 138 is engageable with the piling 126 and rotates as the dock 10 traverses along the piling 126. The spring biased bracket 128 may move between the extended and compressed positions to enhance the stability of the dock 10. In this manner, the brackets 128 may act as shock absorbers. Furthermore, movement of the brackets 128 between the extended and compressed positions mitigates damage to the rollers 138.

Figure 23:
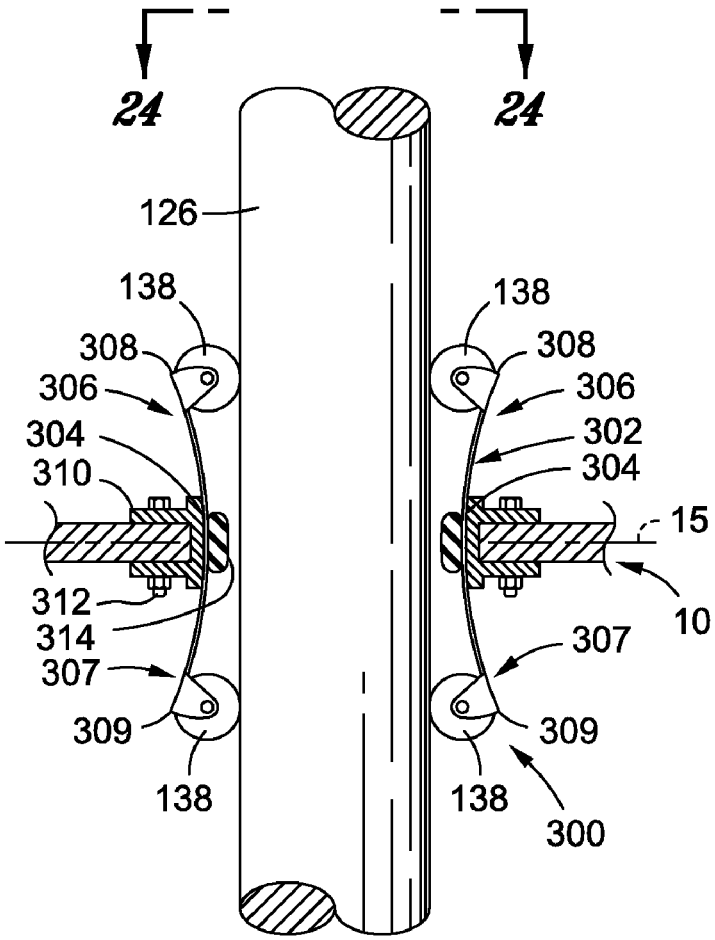
FIG. 23 is a side sectional view of a dock having a second embodiment of a roller assembly connected thereto.

Referring now to FIGS. 23-26, there is shown additional embodiments of a roller assembly for use with the dock 10. FIG. 23 depicts roller assembly 300 including a spring biased bracket 302 connected to the dock 10 (which defines a dock plane 15). The bracket 302 includes a medial portion 304, a first distal portion 306 and a second distal portion 307. The first distal portion 306 defines a first distal end 308, and the second distal portion 307 defines a second distal end 309. The medial portion 304 of the bracket 302 is coupled to the dock 10 with the distal portions 306, 307 extending on opposing sides of the dock plane 15. As shown in FIG. 23, the first distal portion 306 extends away from the water, while the second distal portion 307 extends towards the water. Each distal portion 306, 307 is coupled to a roller 138 which engages with the piling 126.

The bracket 302 is configured to bias the roller 138 into engagement with the piling 126, while at the same time accommodating movement of the dock 10 caused by the waves passing through the water. In this regard, the bracket 302 is flexible to adjust to the movement of the dock 10 relative to the piling 126. In particular, the distal portions 306, 307 are moveable relative to the medial portion 304 in a direction substantially parallel to the dock plane 15 between an extended position and a flexed position. The distal portions 306 of the bracket 302 are biased toward the piling 126 to effectuate engagement with the piling 126. As a section of the dock 10 moves toward the piling 126, the rollers 138 engage with the piling 126 and the medial portion 304 moves toward the distal portions 306, 307 in a direction along the dock plane 15, thereby causing the tension within the bracket 302 to increase as the bracket 302 is flexed from its natural position. As the section of the dock 10 moves away from the piling 126, the tension within the bracket 302 decreases.

The bracket 302 may be connected to the dock 10 via any mechanical fastener known by those skilled in the art. In the embodiment depicted in FIG. 15, the bracket 302 is mounted to the dock 10 via a U-shaped clamp 310 and a bolt 312. A resilient bumper 314 may be disposed between the medial portion 304 of the bracket 302 and the piling 126 to dampen any contact between the medial portion 304 and the piling 126.

Figure 24:
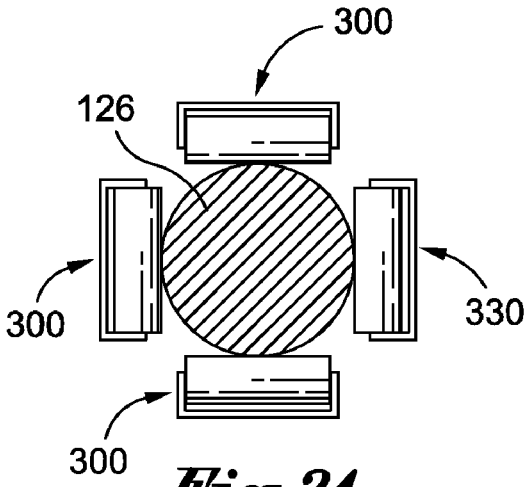
FIG. 24 is a top elevation view of the roller assembly depicted in FIG. 23.

FIG. 24 is a top view of the roller assemblies 300 disposed about the piling 126. As depicted, four sets of roller assemblies 300 are disposed about the piling 126. Each roller assembly 300 is disposed at approximately a right angle relative to the immediately adjacent roller assembly 300. Although FIG. 24 shows four roller assemblies 300 disposed about the piling, it is understood that fewer than four assemblies 300, or more than four assemblies 300 may be used.

Figure 25:
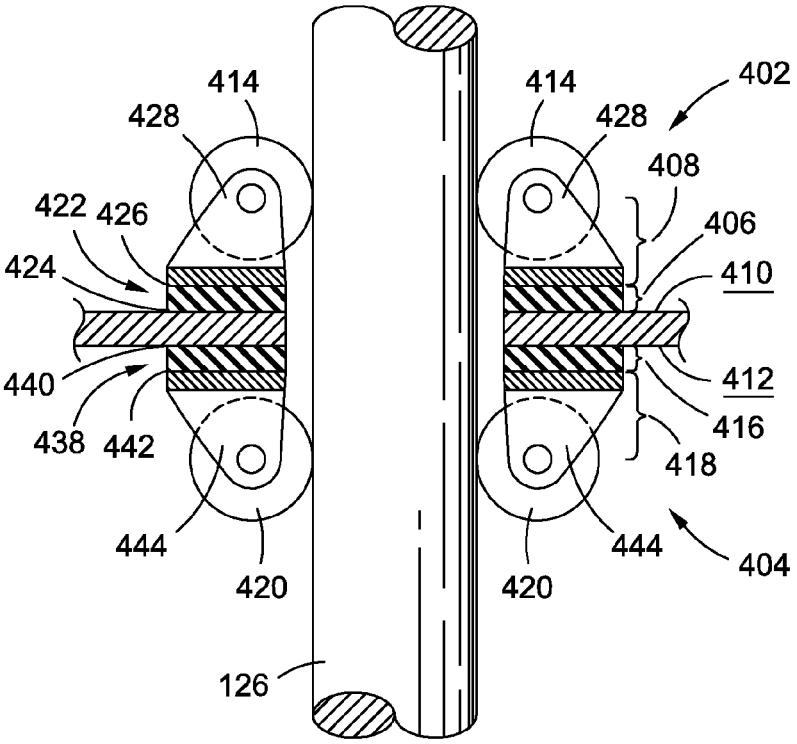
FIG. 25 is a side sectional view of a dock having a third embodiment of a roller assembly connected thereto.

Referring now to FIG. 25, there is shown another embodiment of a roller assembly 400. The roller assembly 400 includes an upper bracket 402 mounted to an upper surface 410 of the dock 10 and a lower bracket 404 mounted to a lower surface 412 of the dock 10. The upper bracket 402 extends away from the water, while the lower bracket 404 extends towards the water. The upper bracket 402 includes an upper dock portion 406 and an upper roller portion 408. The upper dock portion 406 is connectable to the dock upper surface 410 and the upper roller portion 408 is connectable to an upper roller 414. The upper roller portion 408 is moveable relative to the upper dock portion 406 to accommodate the movement of the dock 10 relative to the piling 126.

The lower bracket 404 includes a lower dock portion 416 and a lower roller portion 418. The lower dock portion 416 is connectable to the dock lower surface 412 and the lower roller portion 418 is connectable to a lower roller 420. The lower roller portion 418 is moveable relative to the lower dock portion 416 to accommodate the movement of the dock 10 relative to the piling 126.

According to one embodiment, the upper bracket 402 includes a resilient block 422 defining a dock contact surface 424 and a roller support surface 426. The dock contact surface 424 is connectable to the dock upper surface 410. The roller support surface 426 is moveable relative to the dock contact surface 424. The upper bracket 402 may further include a roller mount 428 connected to the roller support surface 426. The roller mount 428 is sized and configured to connect with the upper roller 414.

Similarly, one embodiment of the lower bracket 404 includes a resilient block 438 defining a dock contact surface 440 and a roller support surface 442. The dock contact surface 440 is connectable to the dock lower surface 412. The roller support surface 442 is moveable relative to the dock contact surface 440. The lower bracket 404 may further include a roller mount 444 connected to the roller support surface 442. The roller mount 444 is sized and configured to connect with the lower roller 420.

Figure 26:
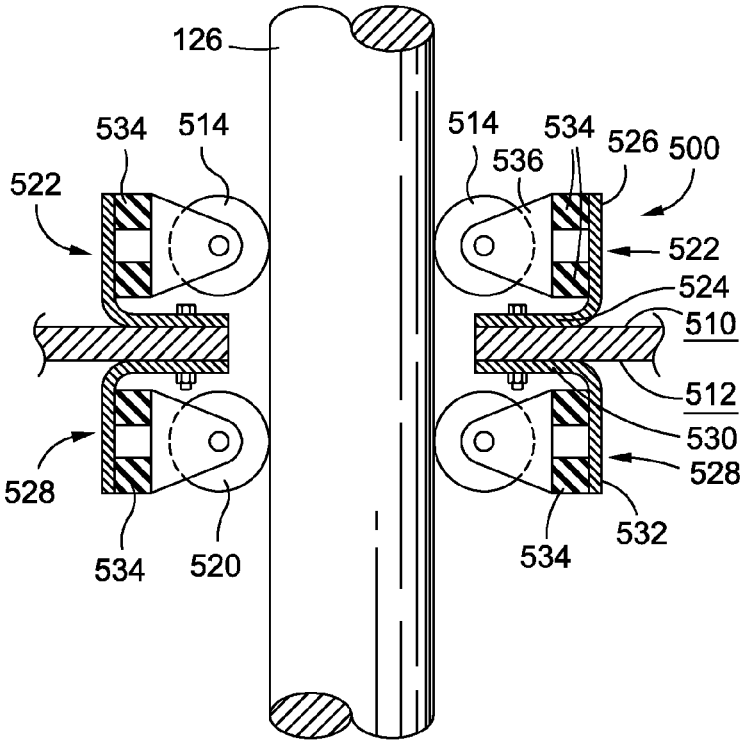
FIG. 26 is a side sectional view of a dock having a fourth embodiment of a roller assembly connected thereto.

Referring now to FIG. 26, there is shown yet another embodiment of a roller assembly 500 having an upper bracket 502 mounted to an upper surface 510 of the dock 10 and a lower bracket 504 mounted to a lower surface 512 of the dock 10. In the regard, the upper bracket 502 extends away from the water, while the lower bracket 504 extends towards the water. According to one embodiment, the upper bracket 502 includes an upper base 522 having a dock plate 524 and a roller plate 526. The dock plate 524 is connectable to the dock upper surface 510 and the roller plate 526 is connected to the upper roller 514. The roller plate 526 is moveable relative to the dock plate 524 between a flexed position and an extended position. The roller plate 526 is substantially orthogonal to the dock plate 524 when the roller plate 526 is in the extended position. The angle between the roller plate 526 and the dock plate 524 decreases as the roller plate 526 moves from the extended position towards the flexed position.

Likewise, one embodiment of the lower bracket 504 includes a lower base 528 having a dock plate 530 and a roller plate 532. The dock plate 530 is connectable to the dock lower surface 512 and the roller plate 532 is connected to the lower roller 520. The roller plate 532 is moveable relative to the dock plate 530 between a flexed position and an extended position. The roller plate 532 is substantially orthogonal to the dock plate 530 when the roller plate 532 is in the extended position. The angle between the roller plate 532 and the dock plate 530 decreases as the roller plate 532 moves from the extended position towards the flexed position.

The upper and lower brackets 502, 504 may also include a resilient member 534, such as a resilient bushing or compression spring, disposed between the bracket 502, 504 and the respective roller 514, 520. The roller 514, 520 may be connected to the resilient member 534 via a roller carrier 536. The roller 514, 520 may be rotatably connected to the roller carrier 536. The resilient member 534 may allow the roller carrier 536 to move relative to the respective bracket 502, 504. In particular, the distance between the roller carrier 536 and the bracket 502, 504 may vary as the dock 10 moves relative to the piling 126.

In addition to the above described roller assemblies, it is also contemplated that other friction reducing devices may be used to allow for generally smooth movement of the dock 10 relative to the piling 126. For example, a block of friction reducing material, such as high density polyethylene or Teflon® may be biased into engagement with the piling 126. In this manner, the friction reducing material may engage with the piling 126 as the dock 10 moves relative to the piling 126.

Figure 15:
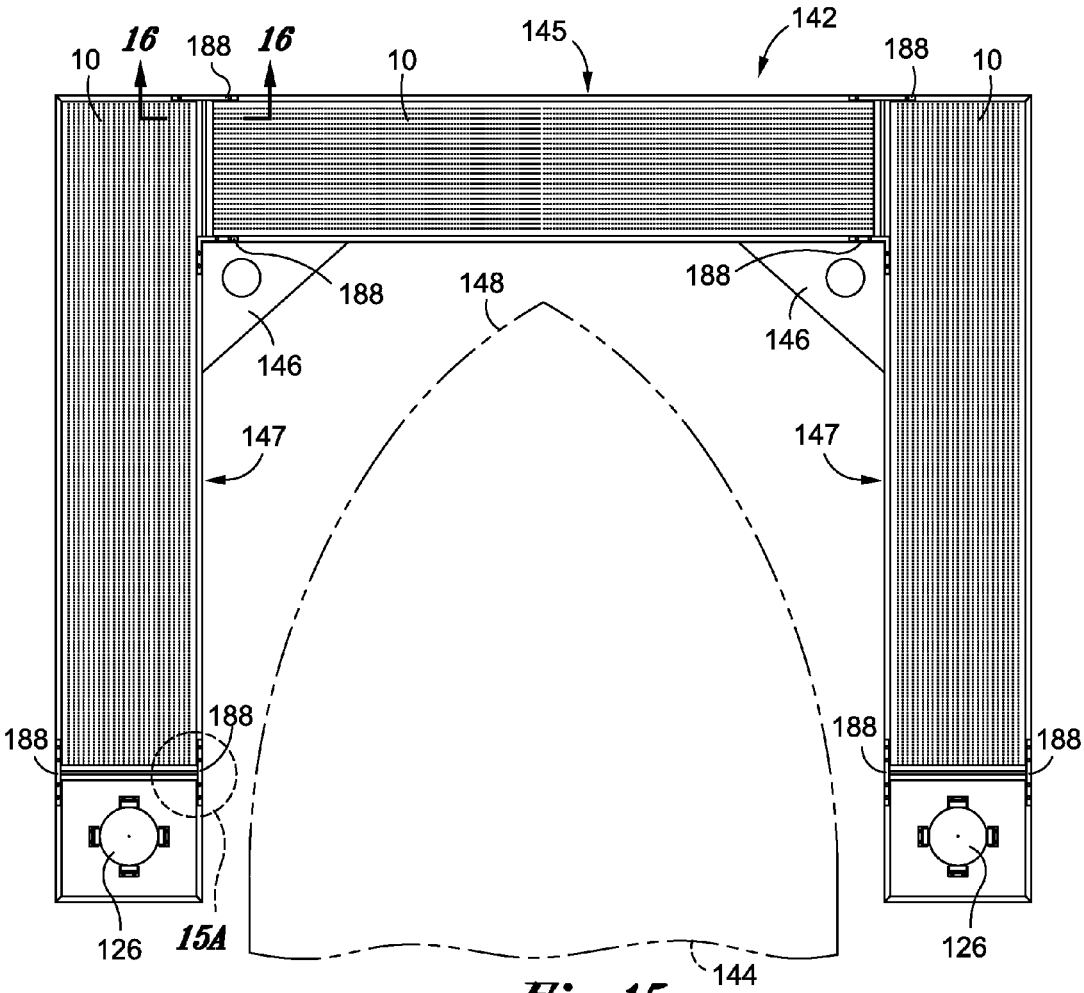
FIG. 15 is a top view of a dock assembly including three docks connected in a u-shaped configuration to form a boat slip.
Figure 15A:
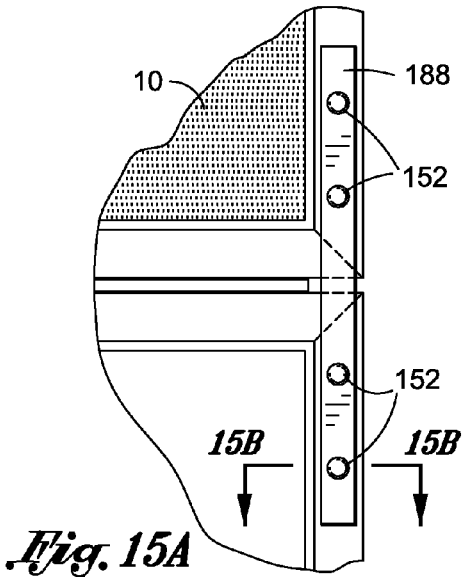
FIG. 15A is an enlarged top view of a section of adjacent dock sections connected by a dock strap.
Figure 15B:
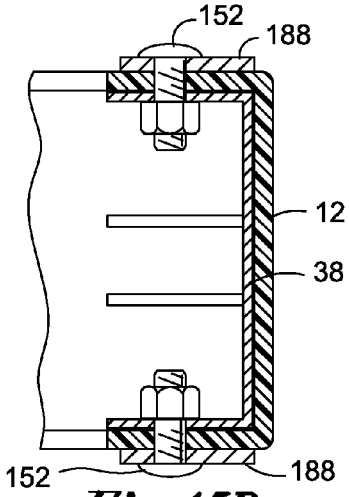
FIG. 15B is a side sectional view of the dock strap connected to the dock.
Figure 16:
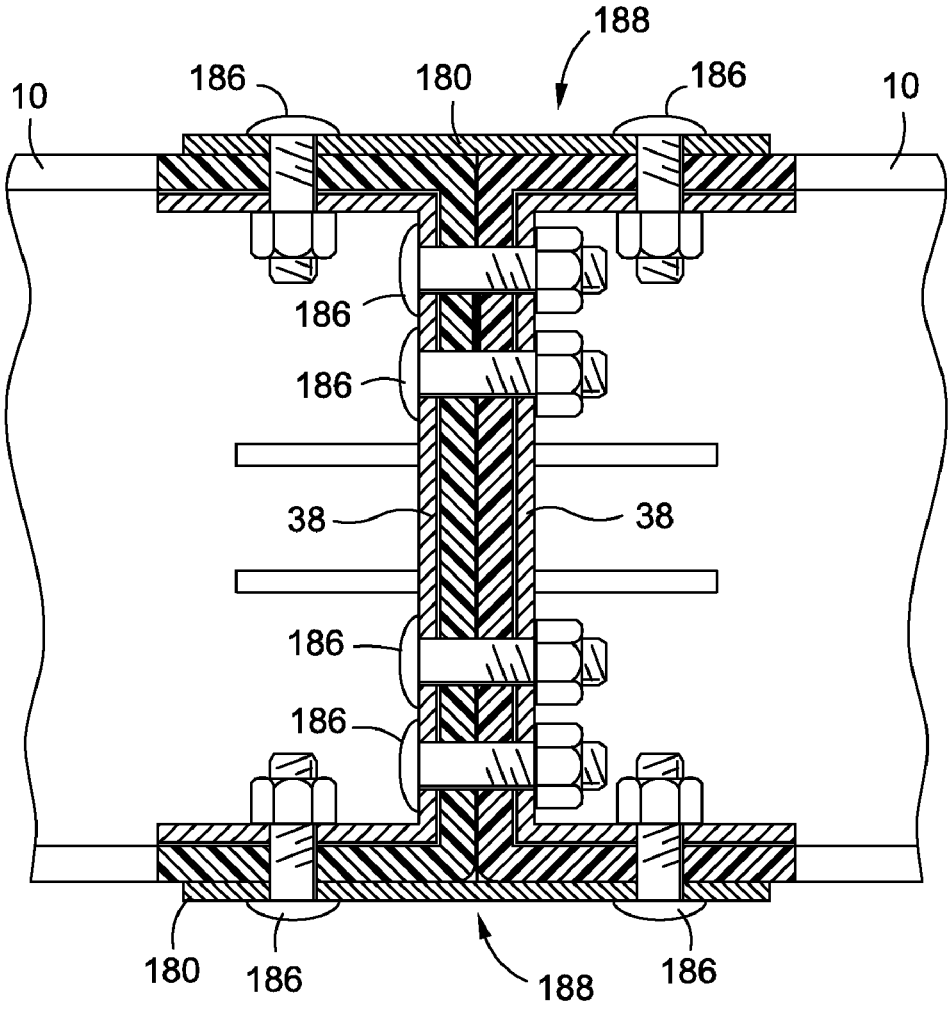
FIG. 16 is a side sectional view of adjacent docks illustrated in FIG. 15, the docks being connected by a dock connector.
Figure 17:
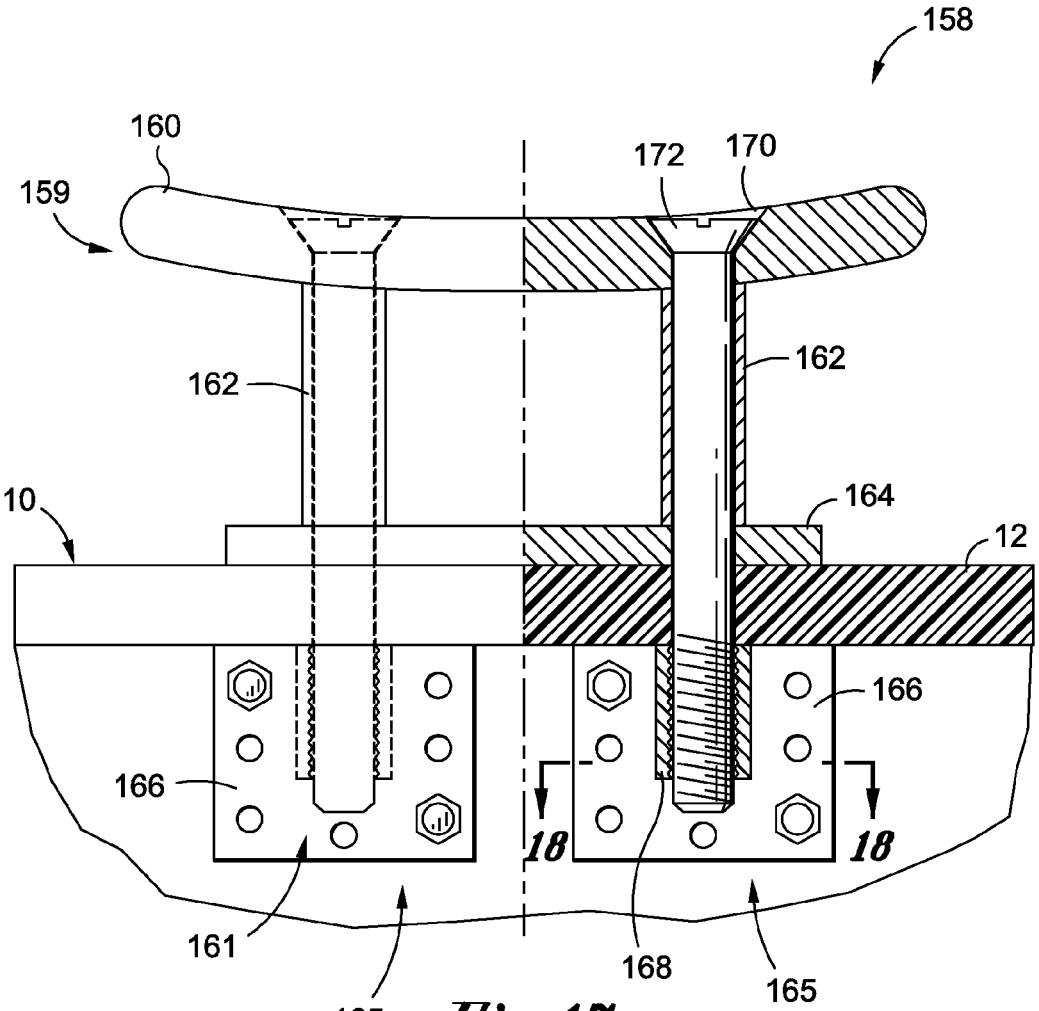
FIG. 17 is a side partial sectional view of a cleat connected to a dock.

Several of the above-described docks 10 may be combined to form a dock assembly 142, as depicted in FIG. 15. The docks 10 may be easily connected in an end-to-end configuration, a side-by-side configuration or in an orthogonal configuration. A dock connector 36 may be employed to connect adjacent docks 10 in an orthogonal configuration, as shown in FIG. 1B. In particular, the dock connector 36 may be mounted on one dock 10 to facilitate orthogonal connection to an adjacent dock 10.

Figure 18:
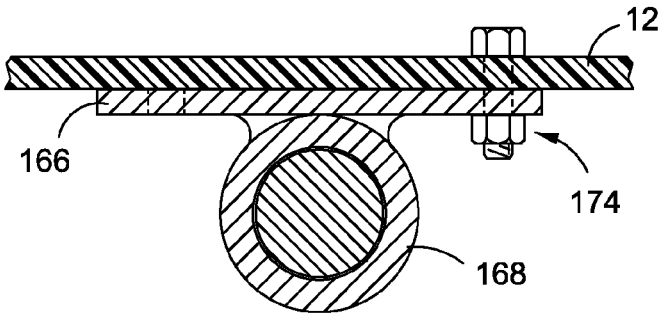
FIG. 18 is a top sectional view of a cleat bolt disposed within a connection cylinder.
Figure 19:
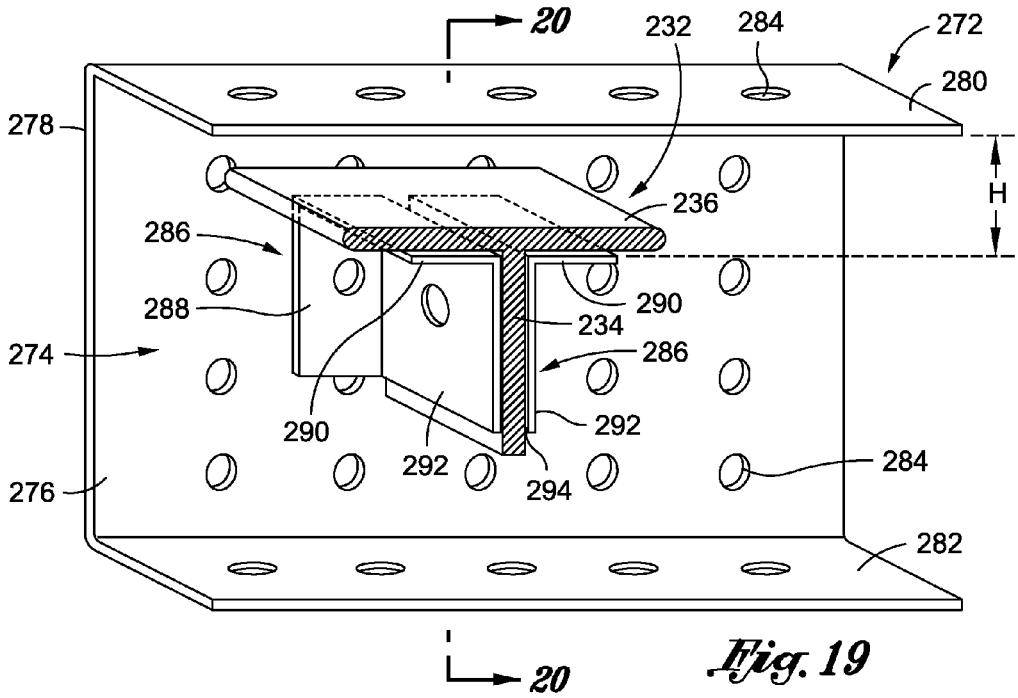
FIG. 19 is an upper perspective view of a second embodiment of a cross member connector and cross member.

As shown in FIGS. 18 and 19, docks 10 may optionally be connected by a dock strap 188. The dock strap 188 attaches to the primary upper and lower flanges 16, 18, as well as the secondary upper and lower flanges 26, 28 of adjacent docks 10. The dock strap 188 includes dock connector external plate 180 that extends between the adjacent docks 10. A dock connector bolt 186 extends connects the connector external plate 180 to the dock 10.

The dock strap 188 may be connected to the upper surfaces of the adjoining docks 10 to achieve the connection. In particular, the dock strap 188 may be connected to the primary frame members 12 and/or secondary frame members 22. A bolt 152 may connect the dock strap 188 to the respective joint support 38 connecting the primary and secondary frame members 12, 22. The dock strap 188 may be formed of a metallic, plastic, or other material known by those skilled in the art.

The dock strap 188 is best illustrated in FIGS. 18A and 18B. As depicted, the dock strap 188 is used to join the dock 10 with a piling platform; however, it is understood that the dock strap 188 may be used to connect adjacent docks 10. The dock strap 188 may mitigate unwanted hogging and sagging of interconnected docks 10. As used herein, sagging refers to when adjacent docks 10 are disposed in a v-shaped configuration, while hogging refers to when docks 10 are disposed in an inverse v-shaped configuration. Rough water conditions may cause adjacent docks 10 to hog or sag.

The dock assembly 142 may be configured in the shape of a slip to allow for docking of a water vessel 144, such as a motor boat or sailboat. In this manner, the dock assembly 142 may define a u-shape having an end portion 145 and two side portions 147. A corner portion 146 may be provided between adjoining docks 10 to provide structural support. In general, when the boat 144 pulls into the slip, the bow 148 of the boat 144 is disposed facing the end portion 145 of the dock assembly 142.

As previously stated, several docks 10 may be connected to form a dock assembly 142. This may be advantageous for a marina having large numbers of slips. The simple attachment and detachment of the docks 10 may allow the marina to quickly and easily reconfigure their slip configuration to accommodate different numbers and sizes of boats. For instance, sailboats tend to be narrower than motorboats. Therefore, the width of the slip for a sailboat may be much narrower than the width of the slip for a motorboat. For marinas having more sailboats than motorboats, thinner slips may be desirable. However, the slips may be easily reconfigured to accommodate wider motorboats.

Figure 20:
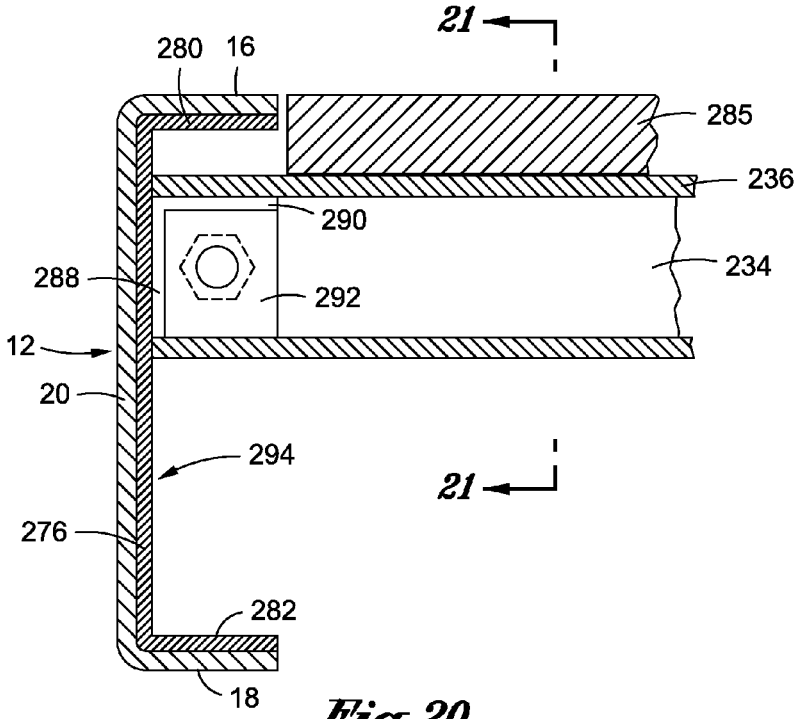
FIG. 20 is a side sectional view of the second embodiment of the cross member connector coupled to a primary frame member.
Figure 19A:
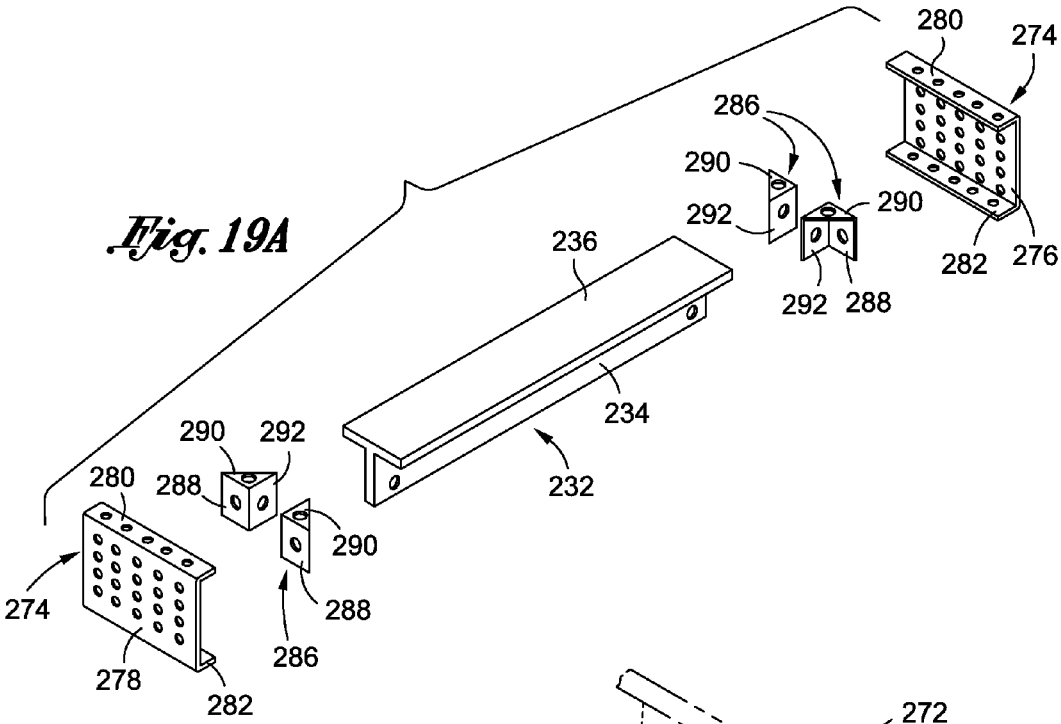
FIG. 19A is an exploded upper perspective view of the cross member connector and the cross member depicted in FIG. 19.
Figure 19B:
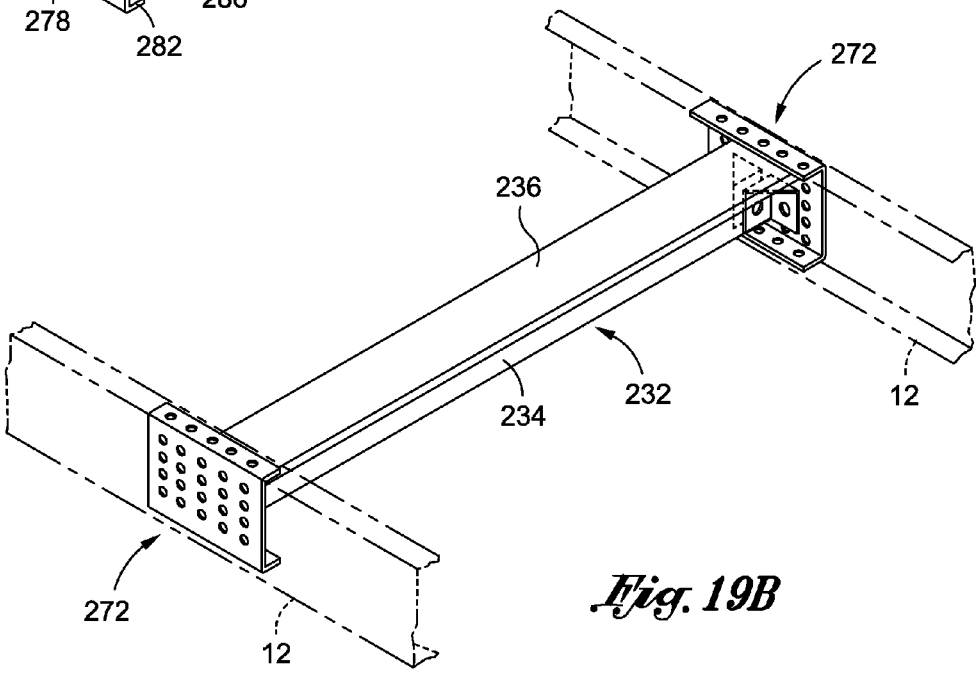
FIG. 19B is an assembled upper perspective view of the cross member connector and the cross member depicted in FIG. 19A.

Once the boat 144 is positioned within the slip, the boat 144 is typically tied or connected to the dock assembly 142. To this end, various aspects of the invention are directed toward a cleat 158 configured to provide a tie-down point for a boat 144 within a slip. Referring now to FIGS. 20 and 21, the cleat 158 is connectable to a primary or secondary frame member 12, 14 and comprises an upper cleat portion 159 and a lower cleat portion 161. The upper cleat portion 159 includes a cleat plate 164 disposable adjacent the frame member 12, 14 and a pair of cleat supports 162 extending from the cleat plate 164. A cleat bar 160 extends between and beyond the cleat supports 162, as shown in FIG. 20. In one embodiment, the cleat bar 160 is substantially straight; however, in the embodiment illustrated in FIG. 20, the cleat bar 160 defines a slight curve. The cleat bar 160 includes a pair of holes 170 aligned with the cleat supports to allow a fastener 172 to be disposed therein, as described in more detail below.

The cleat lower portion 161 includes a pair of cleat connection members 165 mounted to the frame member 12, 14. The connection members 165 include a connection plate 166 and an internally threaded connection cylinder 168. The connection plate 166 includes one or more holes extending therethrough to allow for connection to the frame member 12, 14 by a high-strength adhesive.

In order to fasten the cleat 158 to the frame member 12, 14, the upper cleat portion 159 is connected to the lower cleat portion 161 via a threaded fastener 172. The threaded fastener 172 is inserted through the cleat supports 162 and the connection cylinders 168. In this manner, the individual cleat supports 162 are aligned with respective connection cylinders 168. The fastener 172 is screwed into engagement with the internally threaded connection cylinders 168 to securely fasten the upper cleat portion 159 to the lower cleat portion 161. The holes 170 in the cleat bar 160 may be countersunk to allow the head portion of the fastener 172 to be disposed under the outer surface of the cleat bar 160. As such, the head portion may not be exposed beyond the outer surface of the cleat bar 160.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A unitary support structure comprising:

a plurality of frame members, each frame member being formed from a pultruded material, the plurality of frame members being arranged to define a frame configuration, adjacent ones of the plurality of frame members defining a respective frame member joint;

a joint support disposed within at least one frame member joint, the joint support having a primary joint face and a secondary joint face intersecting with each other and arranged to be complimentary in shape to the respective frame member joint, the primary joint face including a plurality of apertures extending therethrough and the secondary joint face including a plurality of apertures extending therethrough; and an adhesive disposed within the plurality of apertures formed in the primary and secondary joint faces to connect the respective ones of the plurality of frame members to each other to define a unitary structure.

2. The unitary support structure recited in claim 1, further comprising a platform having a first face and an opposing second face disposed in contact with the plurality of frame members.

3. The unitary support structure recited in claim 2, wherein the platform is formed from a fiber-reinforced resin material.

4. The unitary support structure recited in claim 1, wherein the frame configuration defines a quadrangular shape.

5. The unitary support structure recited in claim 1, wherein the unitary support structure defines a dock having an upper walking portion facing away from water and an opposing lower water-facing portion, the dock further comprising a float system including:

a floatation shell disposable beneath the lower water-facing surface of the dock, the floatation shell including:

a shell base; and a pair of opposing floatation fins extending away from the shell base to define respective fin distal portions.

6. The unitary support structure recited in claim 1, wherein the joint support is disposed adjacent internal surfaces of the respective ones of the plurality of frame members.

7. The unitary support structure recited in claim 1, wherein the primary joint face extends at least partially along a first one of the plurality of frame members and the secondary joint face extends at least partially along a second one of the plurality of frame members.

8. The unitary support structure recited in claim 1, wherein the primary joint face is perpendicular to the secondary joint face.

9. A unitary support structure comprising:

a plurality of frame members, each frame member being formed from a pultruded material, the plurality of frame members being arranged to define a frame configuration, adjacent one of the plurality of frame members defining a respective frame member joint;

a joint support disposed within a least one frame member joint and extending along at least two axes, the joint support including a primary joint face extending along a first axis and a secondary joint face extending along a second axis, the primary joint face including a plurality of apertures extending therethrough and the secondary joint face including a plurality of apertures extending therethrough; and an adhesive disposed within the plurality of apertures formed in the primary and secondary joint faces to connect the respective ones of the plurality of frame members to each other to define a unitary structure.

10. The unitary support structure recited in claim 9, wherein the joint support is disposed adjacent internal surface of the respective ones of the plurality of frame members.

11. The unitary support structure recited in claim 9, wherein the primary joint face extends at least partially along a first one of the plurality of frame members and the secondary joint face extends at least partially along a second one of the plurality of frame members.

12. The unitary support structure recited in claim 9, wherein the primary joint face is perpendicular to the secondary joint face.

13. The unitary support structure recited in claim 9, further comprising a platform having a first face and an opposing second face disposed in contact with the plurality of frame members.

14. The unitary support structure recited in claim 13, wherein the platform is form a fiber-reinforced resin material.

15. The unitary support structure recited in claim 9, wherein the unitary support structure defines a dock having an upper walking portion facing away from water and an opposing lower water-facing portion, the dock further comprising a float system including:

a floatation shell disposable beneath the lower water-facing surface of the dock, the floatation shell including:

a shell base; and a pair of opposing floatation fins extending away from the shell base to define respective fin distal portions.

* * * * *